US010364940B2

(12) United States Patent
Givoloup et al.

(10) Patent No.: US 10,364,940 B2
(45) Date of Patent: Jul. 30, 2019

(54) SEALED AND THERMALLY INSULATED TANK FITTED WITH A THROUGH-ELEMENT

(71) Applicant: GAZTRANSPORT ET TECHNIGAZ, Saint Remy les Chevreuse (FR)

(72) Inventors: Hilarion Givoloup, Cergy (FR); Edouard Ducloy, Saint Remy les Chevreuse (FR); Marc Boyeau, Saint Remy les Chevreuse (FR); Antoine Philippe, Gif sur Yvette (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 112 days.

(21) Appl. No.: 15/567,465

(22) PCT Filed: Apr. 15, 2016

(86) PCT No.: PCT/FR2016/050891
§ 371 (c)(1),
(2) Date: Oct. 18, 2017

(87) PCT Pub. No.: WO2016/170254
PCT Pub. Date: Oct. 27, 2016

(65) Prior Publication Data

US 2018/0073678 A1 Mar. 15, 2018

(30) Foreign Application Priority Data

Apr. 20, 2015 (FR) ..... 15 53496

(51) Int. Cl.
*F17C 3/02* (2006.01)
*F17C 13/00* (2006.01)
(Continued)

(52) U.S. Cl.
CPC ..... *F17C 3/027* (2013.01); *F17C 6/00* (2013.01); *F17C 9/00* (2013.01); *F17C 13/004* (2013.01);
(Continued)

(58) Field of Classification Search
CPC .... F17C 3/04; F17C 3/027; F17C 6/00; F17C 9/00; F17C 13/004; F17C 2201/0157; F17C 2201/052; F17C 2203/0358
See application file for complete search history.

(56) References Cited

U.S. PATENT DOCUMENTS 3,379,027 A * 4/1968 Mowell ..... F16L 3/18 114/74 A
9,677,711 B2 * 6/2017 Boyeau ..... F17C 3/027
(Continued)

FOREIGN PATENT DOCUMENTS

FR 2413260 A1 7/1979
FR 2973098 A1 9/2012
(Continued)

*Primary Examiner* — Timothy L Maust
(74) *Attorney, Agent, or Firm* — Berenato & White, LLC

(57) ABSTRACT

A sealed and thermally insulating tank wherein the distance between two adjacent corrugations of the corrugated metal sheets of the sealing membrane is equal to a predetermined corrugation interval io, the sealing membrane comprising, around a through-element:

two notched rectangular metal plates 3io wide in the first direction and 7io long in the second direction, which are symmetrical to one another, each notched rectangular metal plate having three outer edges disposed in line with a plurality of anchor plates and welded onto the first plurality of anchor plates and an inner edge having a notch formed to avoid cutting a square window through which the through-element passes, (Continued)

and two metal retrofit plates disposed between the non-notched portions of the inner edges of the two notched rectangular metal plates.

19 Claims, 10 Drawing Sheets

(51) Int. Cl.
*F17C 6/00* (2006.01)
*F17C 9/00* (2006.01)

(52) U.S. Cl.
CPC ..... *F17C 2201/0157* (2013.01); *F17C 2201/052* (2013.01); *F17C 2203/0333* (2013.01); *F17C 2203/0358* (2013.01); *F17C 2203/0631* (2013.01); *F17C 2205/018* (2013.01); *F17C 2205/0302* (2013.01); *F17C 2205/0355* (2013.01); *F17C 2209/221* (2013.01); *F17C 2221/033* (2013.01); *F17C 2223/0161* (2013.01); *F17C 2223/033* (2013.01); *F17C 2223/047* (2013.01); *F17C 2227/0135* (2013.01); *F17C 2227/0178* (2013.01); *F17C 2260/01* (2013.01); *F17C 2270/0107* (2013.01); *F17C 2270/0113* (2013.01)

(56) References Cited

U.S. PATENT DOCUMENTS

| | | | | |
|---|---|---|---|---|
| 9,982,839 | B2 * | 5/2018 | Herry | F17C 3/027 |
| 9,995,434 | B2 * | 6/2018 | Sassi | F17C 13/004 |
| 10,139,048 | B2 * | 11/2018 | Sassi | F17C 13/004 |
| 10,203,066 | B2 * | 2/2019 | Ducloy | F17C 3/027 |
| 2014/0124086 | A1 * | 5/2014 | Jean | F17C 3/027 141/1 |
| 2015/0354756 | A1 * | 12/2015 | Philippe | B63B 3/68 114/74 A |
| 2017/0138536 | A1 * | 5/2017 | Bleomelen | F17C 13/004 |
| 2017/0292652 | A1 * | 10/2017 | Delanoe | B63B 25/16 |
| 2018/0216782 | A1 * | 8/2018 | Delanoe | F17C 3/027 |

FOREIGN PATENT DOCUMENTS

| | | | |
|---|---|---|---|
| FR | 2984454 | A1 | 6/2013 |
| FR | 3001945 | A1 | 8/2014 |
| WO | WO2011157915 | A1 | 12/2011 |

* cited by examiner

SEALED AND THERMALLY INSULATED TANK FITTED WITH A THROUGH-ELEMENT

CROSS-REFERENCE TO RELATED APPLICATIONS AND CLAIM TO PRIORITY

This application is a national stage application of International Application No. PCT/FR2016/050891 filed Apr. 15, 2016, which claims priority to French Patent Application No. 1553496 filed Apr. 20, 2015, the disclosures of which are incorporated herein by reference and to which priority is claimed.

FIELD OF THE INVENTION

The invention relates to the field of the tanks, which are sealed and thermally insulating, with membranes, for the storage and/or transportation of fluid, such as a cryogenic fluid.

Sealed and thermally insulating tanks with membranes are employed in particular for the storage of liquefied natural gas (LNG), which is stored, at atmospheric pressure, at approximately −162° C.

BACKGROUND OF THE INVENTION

The document WO-A-2011/157915 describes a sealed and thermally insulating tank for the storage of liquefied natural gas, of the type which comprises a tank wall fixed to a flat bearing wall. The tank wall comprises a primary sealing membrane and a thermally insulating barrier disposed between the bearing structure and the primary sealing membrane. The primary sealing membrane essentially consists of a plurality of corrugated metal sheets tightly welded to one another which form a first series of equidistant parallel rectilinear corrugations extending in a first direction of the plane of the bearing wall and a second series of equidistant parallel rectilinear corrugations extending in a second direction of the plane of the bearing wall, the second direction being at right angles to the first direction, the distance between two adjacent corrugations of the first series and the distance between two adjacent corrugations of the second series being equal to a predetermined corrugation interval. The corrugated metal sheets have rectangular forms whose sides are parallel to, respectively, the first direction and the second direction of the plane of the bearing wall and whose dimensions are substantially equal to integer multiples of the corrugation interval, each edge of a corrugated metal sheet being situated between two adjacent corrugations parallel to said edge.

WO-A-2011/157915 proposes structures that allow the passage of a support foot through the bottom wall of the tank. However, when a diameter of the support foot exceeds two corrugation intervals, these structures provide for locally shifting the routing of the corrugations to form more complex networks of corrugations. Now, increasing the complexity of the network of corrugations in this way can prove complicated to implement, particularly in the case where the routing of the corrugations has an effect on other elements of the tank wall, which must then be adapted to the more complex networks of corrugations. These considerations notably come into play when seeking to design the secondary membrane disposed between the primary insulating barrier and the secondary insulating barrier in the form of a corrugated metal membrane.

Similar problems are also likely to arise in the top wall of the tank, for example in a vapor-collecting duct or in the bottom wall of the tank, for example in a sump structure or any other element passing through a singular zone of the tank wall.

SUMMARY OF THE INVENTION

One idea on which the invention is based is to propose a tank wall with a multilayer structure equipped with a through-element passing through a singular zone of the tank wall and in which the structure of the tank wall in said singular zone is simple and connects easily to the adjacent zones of the tank wall.

For that, the invention provides a sealed and thermally insulating tank, said tank comprising a tank wall fixed to a flat bearing wall, the tank wall comprising at least one sealing membrane and at least one thermally insulating barrier disposed between the bearing structure and the sealing membrane, the or each sealing membrane essentially consisting of a plurality of corrugated metal sheets tightly welded to one another which form a first series of equidistant parallel rectilinear corrugations extending in a first direction of the plane of the bearing wall and a second series of equidistant parallel rectilinear corrugations extending in a second direction of the plane of the bearing wall, the second direction being at right angles to the first direction, the distance between two adjacent corrugations of the first series and the distance between two adjacent corrugations of the second series being equal to a predetermined corrugation interval io, the corrugated metal sheets having rectangular forms whose sides are parallel to, respectively, the first direction and the second direction of the plane of the bearing wall and whose dimensions are substantially equal to integer multiples of the corrugation interval, each edge of a corrugated metal sheet being situated between two adjacent corrugations parallel to said edge, the or each thermally insulating barrier essentially consisting of a plurality of juxtaposed insulating panels each having an inner face which forms a support surface for the sealing membrane, the insulating panels having rectangular parallelepipedal forms whose sides are parallel to, respectively, the first direction and the second direction of the plane of the bearing wall and whose dimensions in projection in the plane of the bearing wall are substantially equal to integer multiples of the corrugation interval, metal anchor plates being fixed onto the inner faces of the insulating panels and the corrugated metal sheets having edges welded to said anchor plates to retain the sealing membrane against said support surface, the sealed tank being equipped with a through-element passing through the tank wall.

According to one embodiment, the corrugations of the primary sealing membrane are offset by a half-corrugation interval in each of the two directions of the plane in relation to the corrugations of the secondary sealing membrane, the corrugated metal sheets of the primary sealing membrane are interrupted at an opening, said opening interrupting two corrugations of each series of corrugations of the primary sealing membrane, said opening being centered at a position situated in the middle of the two interrupted corrugations of each series of corrugations of the primary sealing membrane, and the corrugated metal sheets of the secondary sealing membrane are interrupted at an opening, said opening interrupting a sequence of three corrugations of each series of corrugations of the secondary sealing membrane, said opening of the secondary sealing membrane being concentric with the opening of the primary sealing membrane, said opening of the secondary sealing membrane being centered at a position situated at the intersection of the second corrugation of the sequence of three corrugations belonging to the first series of the secondary sealing membrane and of the second corrugation of the sequence of three corrugations belonging to the second series of the secondary sealing membrane.

According to one embodiment, the or one of the thermally insulating barrier(s) around the or one of the through-elements comprises a plurality of insulating panels which form a ring of square form around the through-element, said ring having outer sides measuring substantially 9io which are parallel to, respectively, the first direction and the second direction of the plane of the bearing wall, said ring delimiting, at its center, a square window whose sides measure substantially 3io and which are also parallel to, respectively, the first direction and the second direction of the plane of the bearing wall, such that the through-element passes through the thermally insulating barrier in said square window, a first plurality of anchor plates being disposed on the inner face of said ring along the four outer sides of said ring, the distance between each anchor plate of the first plurality and the outer side that it rungs along being equal to the corrugation interval, link parts linked tightly to the through-element being disposed in the square window around the through-element on the inner face of the insulating panels which form the ring.

According to one embodiment, the corrugated metal sheets of the or one of the sealing membrane(s) around the through-element comprise: two notched rectangular metal plates 3io wide in the first direction and 7io long in the second direction, which are symmetrical to one another in relation to an axis of symmetry parallel to the second direction passing through the center of the square window, called second axis of symmetry, each notched rectangular metal plate having three outer edges disposed in line with the first plurality of anchor plates and welded onto the first plurality of anchor plates and an inner edge having a notch formed to avoid cutting said square window, said notch having a width equal to 1io in the first direction and a length equal to 3io in the second direction so that the notched portion of the inner edge runs along the square window, and two metal retrofit plates disposed between the non-notched portions of the inner edges of the two notched rectangular metal plates, the two metal retrofit plates being symmetrical to one another in relation to an axis of symmetry parallel to the first direction passing through the center of the square window, called first axis of symmetry, each metal retrofit plate being 1io wide in the first direction and 2io long in the second direction and having a corrugation aligned on said second axis of symmetry, the two longitudinal edges of each metal retrofit plate being tightly welded to the inner edges of the two notched rectangular metal plates, and the outer lateral edge of each metal retrofit plate being welded to the anchor plates of the first plurality, the notched portion of the inner edge of each notched rectangular metal plate and the inner lateral edge of each metal retrofit plate being tightly welded to said link parts.

By virtue of these features, it is possible to allow the passage of a through-element that is relatively bulky, namely having a diameter of up to 3io, while avoiding the concentrations of strains in the sealing membrane around the through-element. Indeed, this very symmetrical design of the sealing membrane makes it possible to stress the different corrugations in a fairly balanced way to take up the deformations caused by the thermal and mechanical stresses. Furthermore, by providing a symmetrical zone of the thermally insulating barrier with dimensions of 9io by 9io, this structure is relatively easy to connect to the adjacent zones of the tank wall, in particular when the latter are formed by insulating panels with dimensions of 3io by 9io. Finally, by providing a zone of the sealing membrane with dimensions of 7io by 7io that is symmetrical and concentric with the zone of the thermally insulating barrier, this structure creates an offset between the edges of the insulating panels and the edges of the corrugated metal sheets of the sealing membrane, which also simplifies the connection to the adjacent zones of the tank wall, where it is generally necessary for a corrugated metal sheet to overlap several insulating panels.

The link parts which are disposed in the square window between the metal plate to whose inner edges they are welded and the through-element to which they are tightly linked can be arranged in many ways.

In one embodiment, these link parts comprise a tray parallel to the bearing wall linked to the periphery of the through-element and extending around the main body at the same level at the inner face of the ring, and closure plates whose inner edges are welded onto this tray. Other configurations are possible to produce the sealing around the through-element, for example by means of a flange borne by the through-element and whose downward-facing edge is welded onto one or more metal closure plates surrounding the through-element. A sealed link using such a flange between a metal membrane and a rod passing through this membrane is for example illustrated in FR-A-2973098 or FR-A–2413260.

According to other advantageous embodiments, such a sealed and thermally insulating tank can have one or more of the following features.

According to one embodiment, said thermally insulating barrier is a secondary thermally insulating barrier retained against the bearing structure, and said sealing membrane is a secondary sealing membrane borne by the secondary thermally insulating barrier, the tank wall further comprising a primary thermally insulating barrier resting against the secondary sealing membrane and a primary sealing membrane borne by the primary thermally insulating barrier and intended to be in contact with the fluid contained in the tank.

According to embodiments, the through-element can comprise a support foot for a piece of equipment intended to be placed in the tank, or a sealed duct defining a passage between the interior space of the tank and the outside of the tank, or even a sump structure.

Such a tank can form part of an onshore storage installation, for example for storing LNG, or be installed in a coastal or deep-water floating structure, in particular a methane or ethane tanker, a floating storage and regasification unit (FSRU), an offshore floating production and storage unit (FPSO) and the like.

According to one embodiment, a ship for transporting a fluid comprises a double hull and an abovementioned tank disposed in the double hull.

According to one embodiment, the invention also provides a method for loading or unloading such a ship, in which a fluid is routed through insulated pipelines from or to a floating or onshore storage installation to or from the tank of the ship.

According to one embodiment, the invention also provides a transfer system for a fluid, the system comprising the abovementioned ship, insulated pipelines arranged so as to link the tank installed in the hull of the ship to a floating or onshore storage installation and a pump for driving a fluid through the insulated pipelines from or to the floating or onshore storage installation to or from the tank of the ship.

Some aspects of the invention are based on the idea of providing a multilayer wall structure implementing, to the greatest possible extent, the following construction principles:

- Insulating panels and corrugated metal sheets have rectangular forms of dimensions equal to integer multiples of the corrugation interval, these dimensions being as standardized as possible to form a periodic pattern that is repeatable over great extents.
- The edges of the corrugated metal sheets are offset in relation to the edges of the insulating panels which support these corrugated metal sheets.
- The edges of the corrugated metal sheets of the secondary membrane are aligned with the edges of the primary insulating panels which they cover.
- The corrugations of the corrugated metal sheets of the secondary membrane protrude toward the outside of the tank and are offset in relation to the edges of the secondary insulating panels which support them.
- An edge of a corrugated metal sheet is at a distance of 0.5io from the adjacent corrugation parallel to said edge, where io denotes the corrugation interval.

BRIEF DESCRIPTION OF THE DRAWINGS

The invention will be better understood, and other aims, details, features and advantages thereof will become more clearly apparent from the following description of several particular embodiments of the invention, given purely in an illustrative and nonlimiting manner, with reference to the attached drawings.

DETAILED DESCRIPTION OF THE PREFERRED EMBODIMENT(S)

By convention, the terms "outer" and "inner" are used to define the relative position of one element in relation to another, by reference to the interior and the exterior of the tank. Furthermore, the longitudinal direction of a rectangular parallelepipedal element should be understood to be the direction corresponding to the side of greatest dimension of the rectangle.

Figure 1:
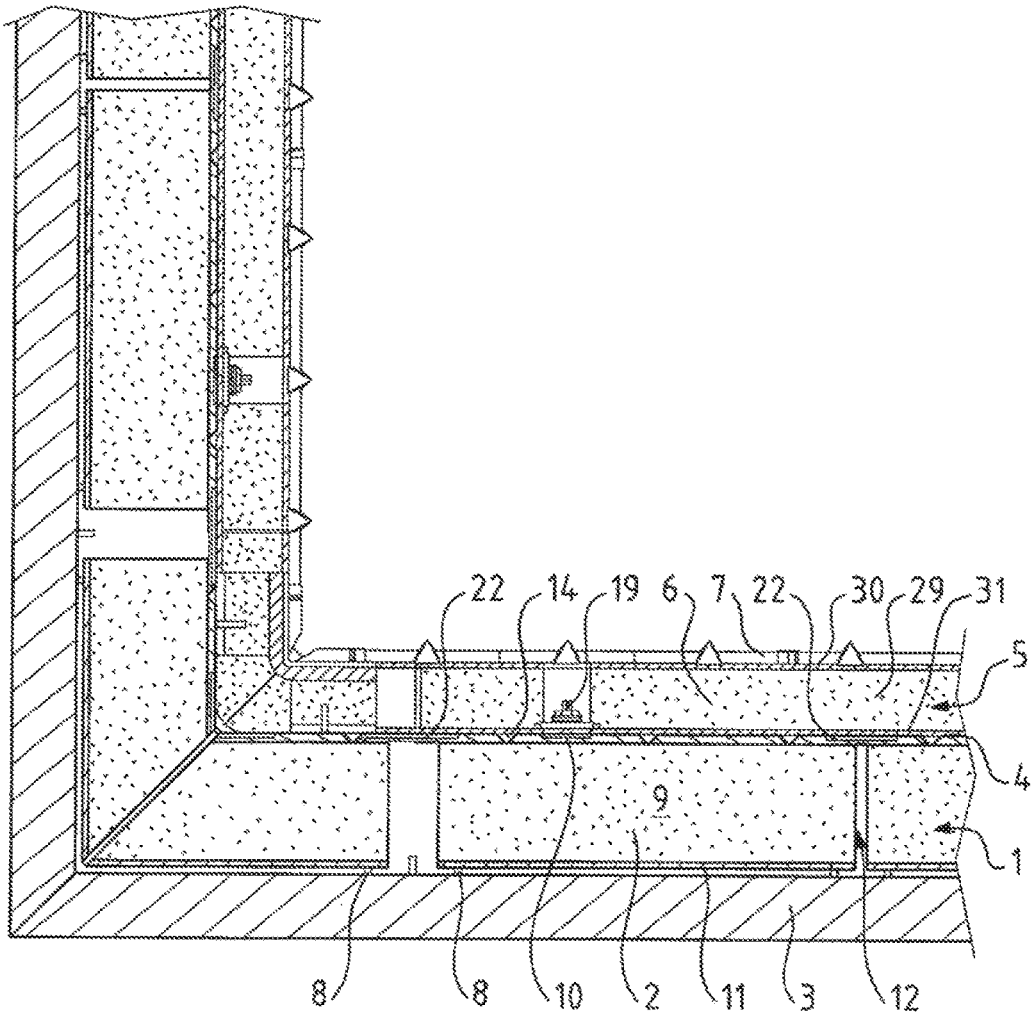
FIG. 1 is a cross-sectional view of a sealed and thermally insulating tank for storing liquefied natural gas in a corner zone between two walls.
Figure 2:
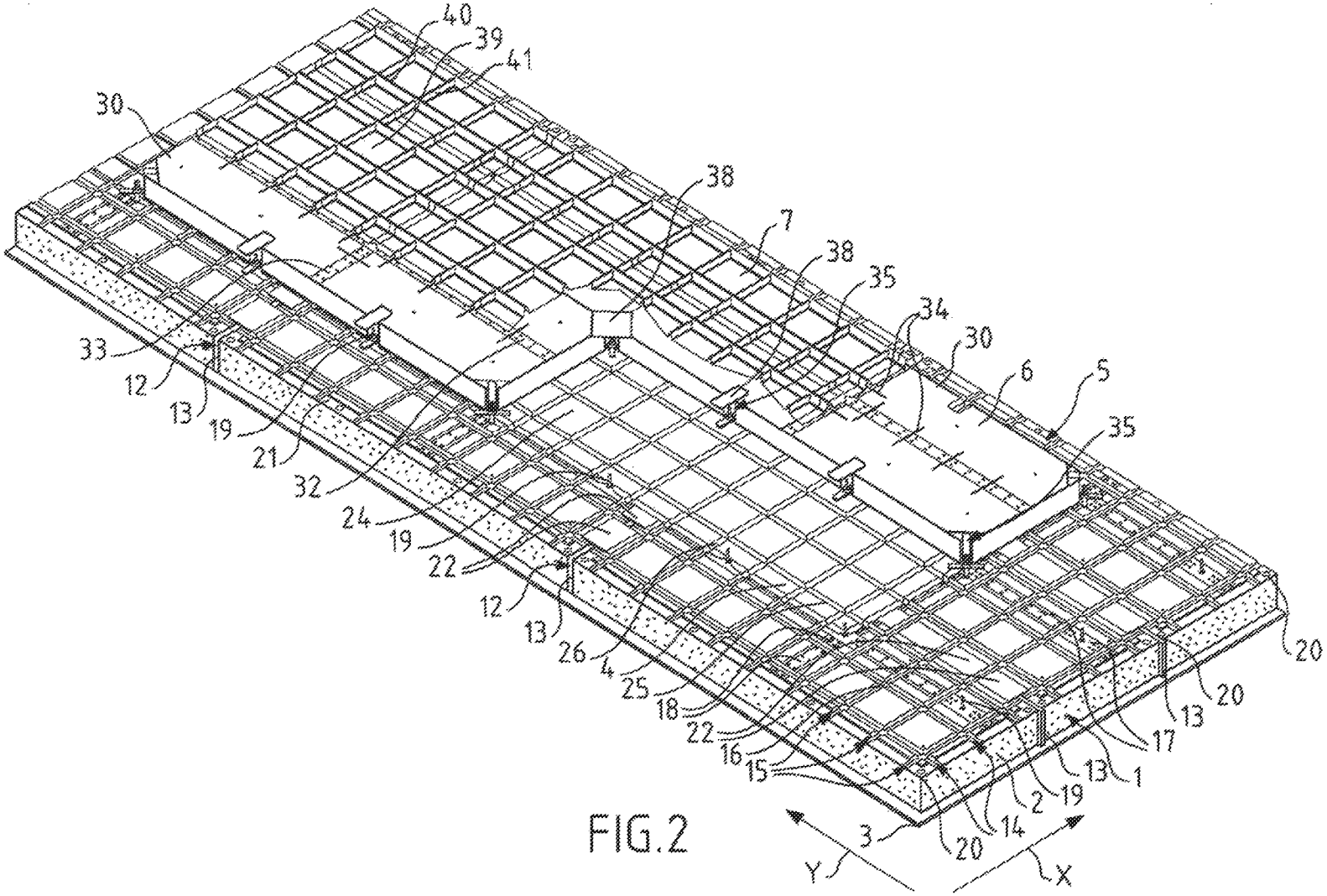
FIG. 2 is a cutaway perspective view of a wall of the tank in a standard zone.

In relation to FIGS. 1 and 2, the multilayer structure of a sealed and thermally insulating liquefied natural gas storage tank is described. Each wall of the tank comprises, from the outside to the inside of the tank, a secondary thermally insulating barrier 1 comprising insulating panels 2 juxtaposed with and anchored to a bearing wall 3 by secondary retaining members 8, a secondary sealing membrane 4 borne by the insulating panels 2 of the secondary thermally insulating barrier 1, a primary thermally insulating barrier 5 comprising insulating panels 6 juxtaposed with and anchored to the insulating panels 2 of the secondary thermally insulating barrier 1 by primary retaining members 19 and a primary sealing membrane 7, borne by the insulating panels 6 of the primary thermally insulating barrier 5 and intended to be in contact with the liquefied natural gas contained in the tank.

The bearing wall 3 can in particular be a self-supporting metal sheet or, more generally, any type of rigid partition exhibiting appropriate mechanical properties. The bearing wall 3 can notably be formed by the hull or the double hull of a ship. As sketched in FIG. 1, a plurality of bearing walls 3 is used typically to form a bearing structure having the general form of the tank, usually a polyhedral form.

The secondary thermally insulating barrier 1 comprises a plurality of insulating panels 2 anchored to the bearing wall 3 by means of beads of resin, not illustrated, and/or studs 8 welded to the bearing wall 3. The insulating panels 2 have a substantially rectangular parallelepipedal form.

As illustrated in FIG. 1, the insulating panels 2 each comprise a layer of insulating polymer foam 9 sandwiched between an inner rigid plate 10 and an outer rigid plate 11. The inner 10 and outer 11 rigid plates are, for example, plates of plywood glued onto said layer of insulating polymer foam 9. The insulating polymer foam can in particular be a polyurethane-based foam. The polymer foam is advantageously reinforced by glass fibers contributing to reducing its thermal contraction coefficient.

In a standard zone of a wall, as represented in FIG. 2, the insulating panels 2 are juxtaposed in parallel rows and separated from one another by interstices 12 guaranteeing a functional mounting play. The interstices 12 are filled with a heat-insulating packing 13, represented in FIG. 2, such as glass wool, rock wool or open-cell flexible synthetic foam for example. The heat-insulating packing 13 is advantageously produced in a porous material so as to form spaces for the flow of gas in the interstices 12 between the insulating panels 2. The interstices 12 have, for example a width of the order of 30 mm.

As represented in FIG. 2, the inner plate 10 has two series of grooves 14, 15, at right angles to one another, so as to form a network of grooves. Each of the series of grooves 14, 15 is parallel to two opposing sides of the insulating panels 2. The grooves 14, 15 are intended to receive corrugations, protruding toward the outside of the tank, formed on the metal sheets of the secondary sealing membrane 4. In FIG. 2, each inner plate 10 comprises three grooves 14 extending in the longitudinal direction of the insulating panel 2 and nine grooves 15 extending in the transverse direction of the insulating panel 2.

The grooves 14, 15 pass right through the thickness of the inner plate 10 and thus emerge at the layer of insulating polymer foam 9. Moreover, the insulating panels 2 comprise, in the zones of intersection between the grooves 14, 15, clearance orifices 16 formed in the layer of insulating polymer foam 9. The clearance orifices 16 provide a housing for the node zones, formed at the intersections between the corrugations of the metal sheets of the secondary sealing membrane 4.

Moreover, the inner plate 10 is equipped with metal mounting plates 17, 18 for anchoring the edge of the corrugated metal sheets of the secondary sealing membrane 4 on the insulating panels 2. The metal mounting plates 17, 18 extend in two directions at right-angles to each other which are each parallel to two opposing sides of the insulating panels 2. The metal mounting plates 17, 18 are fixed onto the inner plate 10 of the insulating panel 2, by screws, rivets, or staples, for example. The metal mounting plates 17, 18 are placed in voids formed in the inner plate 10 such that the inner surface of the metal mounting plates 17, 18 is flush with the inner surface of the inner plate 10.

The inner plate 10 is also equipped with threaded studs 19 protruding toward the interior of the tank, and intended to ensure the fixing of the primary thermally insulating barrier 5 onto the insulating panels 2 of the secondary thermally insulating barrier 1. On each insulating panel 2, three studs 19 are placed along the longitudinal line formed by the mounting plates 17, namely one stud 19 is placed at the intersection between the line formed by the mounting plates 17 and the line formed by the mounting plates 18 and two studs are placed equidistantly on either side thereof.

In order to ensure the fixing of the insulating panels 2 to the studs 8 fixed to the bearing wall 3, the insulating panels 2 are provided with cylindrical wells 20, represented in FIG. 2, passing through the insulating panels 2 right through their thickness and formed in each of the four corners of the insulating panels 2. The cylindrical wells 2 exhibit a change of section, not illustrated, defining bearing surfaces for nuts cooperating with the threaded ends of the studs 8.

Moreover, the inner plate 10 has, along its edges, in each interval between two successive grooves 14, 15, a setback receiving bridging plates 22 which are each disposed straddling between two adjacent insulating panels 2, astride the interstice 12 between the insulating panels 2. Each bridging plate 22 is fixed against each of the two adjacent insulating panels 2 so as to oppose their mutual separation. The bridging plates 22 have a rectangular parallelepipedal form and, for example, consist of a plate of plywood. The outer face of the bridging plates 22 is fixed against the bottom of the setbacks 21. The depth of the setbacks 21 is substantially equal to the thickness of the bridging plates 22 such that the inner face of the bridging plates 22 comes substantially level with the other flat zones of the inner plate 10 of the insulating panel. Thus, the bridging plates 22 are able to ensure a continuity in the bridging of the secondary sealing membrane 4.

So as to ensure a good distribution of the link loads between the adjacent panels, a plurality of bridging plates 22 extends along each edge of the inner plate 10 of the insulating panels 2, a bridging plate 22 being disposed in each interval between two neighboring grooves 14, 15 of a series of parallel grooves. The bridging plates 22 can be fixed against the inner plate 10 of the insulating panels 2 by any appropriate means. It has, however been found that the combination of the application of a glue between the outer face of the bridging plates 22 and the inner plate 10 of the insulating panels 2 and the use of mechanical fixing members, such as staples, making it possible to apply pressure to the bridging plates 22 against the insulating panels 2, was particularly advantageous.

The secondary sealing membrane 4 comprises a plurality of corrugated metal sheets 24 each having a substantially rectangular form of dimensions equal to the dimensions of an insulating panel 2. The corrugated metal sheets 24 are disposed in an offset manner in relation to the insulating panels 2 of the secondary thermally insulating barrier 1 such that each of said corrugated metal sheets 24 extends jointly over four adjacent insulating panels 2. Each corrugated metal sheet 24 has a first series of parallel corrugations 25 extending in a first direction and a second series of parallel corrugations 26 extending in a second direction. The directions of the series of corrugations 25, 26 are at right angles. Each of the series of corrugations 25, 26 is parallel to two opposing edges of the corrugated metal sheet 24. The corrugations 25, 26 protrude toward the outside of the tank, that is to say in the direction of the bearing wall 3. The corrugated metal sheet 24 comprises, between the corrugations 25, 26, a plurality of flat surfaces. At each intersection between two corrugations 25, 26, the metal sheet comprises a node zone having a peak protruding toward the outside of the tank. The corrugations 25, 26 of the corrugated metal sheets 24 are housed in the grooves 14, 15 formed in the inner plate 10 of the insulating panels 2. The adjacent corrugated metal sheets 24 are welded together with overlap. The anchoring of the corrugated metal sheets 24 onto the metal mounting plates 17, 18 is done by spot welds.

The corrugated metal sheets 24, comprise, along their longitudinal edges and in their four corners, cutouts 28 allowing the passage of the studs 19 intended to ensure the fixing of the primary thermally insulating barrier 5 onto the secondary thermally insulating barrier 1. Two cutouts 28 are situated along each longitudinal edge, respectively at one third and two thirds of the length of the corrugated metal sheet 24.

The corrugated metal sheets 24 are, for example, produced in Invar®: that is to say an alloy of iron and nickel whose expansion coefficient is typically between 1.2×10-6 and 2×10-6 K−1, or in an alloy of iron with high manganese content whose expansion coefficient is typically of the order of 7×10-6 K−1. Alternatively, the corrugated metal sheets 24 could also be produced in stainless steel or in aluminum.

The primary thermally insulating barrier 5 comprises a plurality of insulating panels 6 of substantially rectangular parallelepipedal form having dimensions equal to the dimensions of an insulating panel 2, apart from the thickness which can be different, preferably smaller than that of the insulating panel 2. The insulating panels 6 are here offset in relation to the insulating panels 2 of the secondary thermally insulating barrier 1 such that each insulating panel 6 extends over four insulating panels 2 of the secondary thermally insulating barrier 1. In a standard zone, the insulating panels 6 of the primary thermally insulating barrier 5 and the insulating panels 2 of the secondary thermally insulating barrier 1 are oriented such that the longitudinal directions of the insulating panels 2, 6 are parallel to one another.

The insulating panels 6 comprise a structure similar to that of the insulating panels 2 of the secondary thermally insulating barrier 1, namely a sandwich structure consisting of a layer of insulating polymer foam sandwiched between two rigid plates, for example of plywood. The inner plate 30 of an insulating panel 6 of the primary thermally insulating barrier 5 is equipped with metal mounting plates 32, 33 for anchoring the corrugated metal sheets of the primary sealing membrane 7. The metal mounting plates 32, 33 extend along two right-angled rows which are each parallel to two opposing edges of the insulating panel 6. The metal mounting plates 32, 33 are fixed in voids formed in the inner plate 30 of the insulating panel 6 and fixed thereto, by screws, rivets or staples for example.

Moreover, the inner plate 30 of the insulating panel 6 is provided with a plurality of relaxation slits 34 allowing the primary sealing membrane 7 to be deformed without imposing excessive mechanical strains on the insulating panels 6. Such relaxation slits are in particular described in the document FR 3001945.

The fixing of the insulating panels 6 of the primary thermally insulating barrier onto the insulating panels 2 of the secondary thermally insulating barrier is ensured by means of threaded studs 19. For this, each insulating panel 6 comprises a plurality of cutouts 35 along its edges and in its corners, inside which extends a threaded stud 19. The outer plate of the insulating panels 2 overhangs into the cutouts 35 so as to form a bearing surface for a retaining member which comprises a threaded bore threaded onto each threaded stud 19. The retaining member comprises lugs housed inside the cutouts 35 and coming to bear against the portion of the outer plate overhanging into the cutout 35 so as to sandwich the outer plate between a lug of the retaining member and an insulating panel 2 of the secondary thermally insulating barrier 1 and thus ensure the fixing of each insulating panel 6 onto the insulating panels 2 that it overlaps.

The primary thermally insulating barrier 5 comprises a plurality of closure plates 38 making it possible to complete the bearing surface of the primary sealing membrane 7 at the cutouts 35.

The primary sealing membrane 7 is obtained by assembling a plurality of corrugated metal sheets 39. Each corrugated metal sheet 39 has a substantially rectangular form of dimensions equal to the dimensions of an insulating panel 2 or 6. Each corrugated metal sheet 39 comprises a first series of so-called top parallel corrugations 40, extending in a first direction corresponding to the greatest dimension of the corrugated metal sheet, and a second series of so-called bottom parallel corrugations 41, extending in a second direction at right angles to the first series. The corrugations 40, 41 protrude toward the interior of the tank. The corrugated metal sheets 39 are, for example, produced in stainless steel or in aluminum. In an embodiment not illustrated, the first and second series of corrugations have identical heights.

Each corrugated metal sheet 39 is placed straddling over four insulating panels 6 such that each edge of the corrugated metal sheet 39 covers a row of metal mounting plates 32 or 33 borne by the underlying panel 6. The adjacent corrugated metal sheets 39 are welded to one another with overlap. The anchoring of the corrugated metal sheets 39 onto the metal mounting plates 32 and 33 is done by spot welds.

Preferably, each edge of a corrugated metal sheet 24 or 39 is situated substantially mid-way between two parallel adjacent corrugations of the secondary, respectively primary, membrane. This position of the sheet edge can be modified locally to make fine adjustments.

Referring to FIGS. 3 to 9, there now follows a description of a singular zone of the bottom wall of the tank, through which passes a through-element, here a support foot designated 50 overall, to support a piece of equipment intended to be placed in the tank. Elements that are similar or identical to those of the standard zone described above bear the same reference numeral as in the standard zone.

Figure 3:
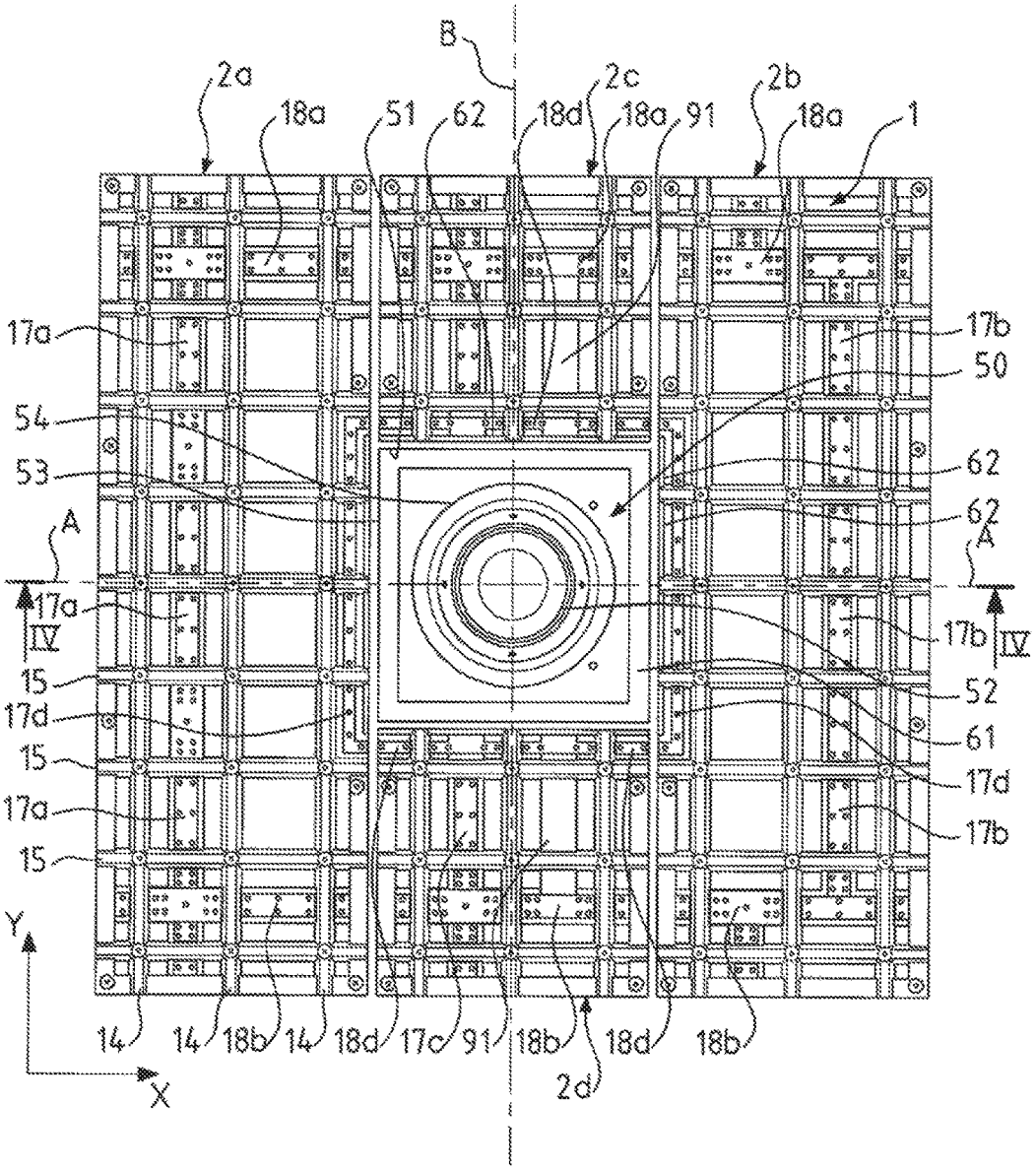
FIG. 3 is a plan view of the inner face of a bottom wall of the tank in a singular zone through which a support foot passes, showing the secondary insulating barrier around the support foot without bridging elements.

FIG. 3 shows the secondary thermally insulating barrier 1 in the singular zone, which forms a ring of square form around the support foot 50. This ring has outer sides measuring substantially 9io which are parallel to, respectively, the first direction X and the second direction Y of the plane of the bearing wall. The ring delimits, at its center, a square window 51 whose sides measure substantially 3io and which are also parallel to, respectively, the direction X and the direction Y of the plane of the bearing wall. The support foot 50 passes through the thermally insulating barrier 1 in said square window 51.

More specifically, the ring of square form of the thermally insulating barrier 1 consists of two long insulating panels 2*a* and 2*b* having a width of 3io in the first direction X and a length of 9io in the second direction Y and two short insulating panels 2*c* and 2*d* having a width of 3io in the first direction and a length of 3io in the second direction. The long insulating panels 2*a* and 2*b* are disposed in the alignment of one another in the first direction X spaced apart by a distance of 3io in the first direction X to delimit the square window 51 in the first direction. The short insulating panels 2*c* and 2*d* are disposed between the two long insulating panels 2*a* and 2*b* in the alignment of one another in the second direction Y and spaced apart by a distance of 3io in the second direction Y to delimit the square window 51 in the second direction Y.

By virtue of this arrangement, the thermally insulating barrier consists entirely of rows of insulating panels having a width of 3io in the first direction, which facilitates the connection to the adjacent zones of the tank wall, given that such rows exist also in the standard zone of the tank wall.

Figure 4:
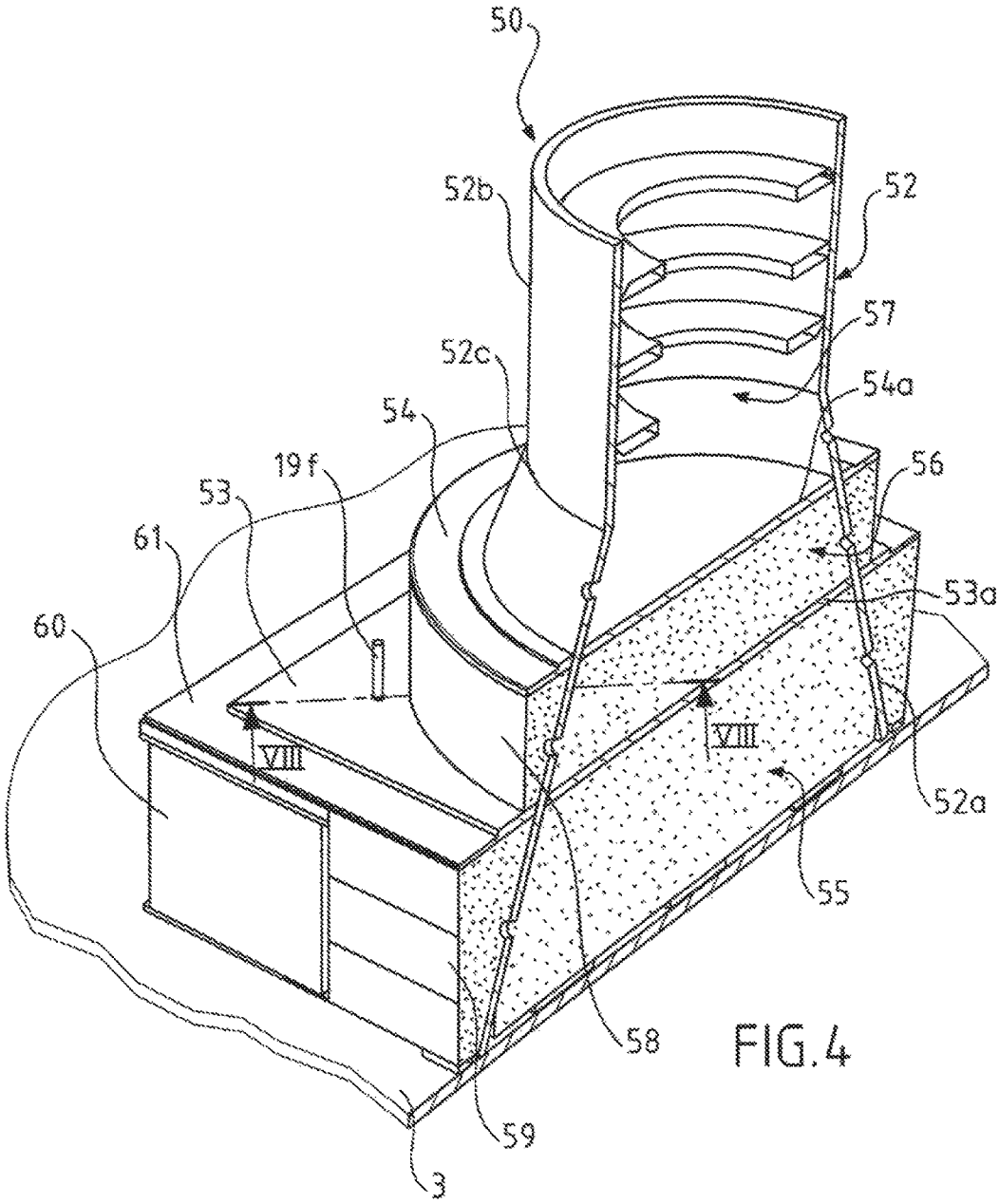
FIG. 4 is a half-perspective view in cross section of the support foot, the cross section being taken along the axis IV-IV of FIG. 3.

The support foot 50 will now be described more specifically with reference to FIG. 4. The support foot 50 comprises in particular a main body 52 disposed substantially at the center of the square window 51 and extending in the direction of thickness of the tank wall, a first tray 53 parallel to the bearing wall 3 linked to the periphery of the main body and extending around the main body 52 at the same level as the inner face of the ring, and a second tray 54 parallel to the bearing wall 3 linked to the periphery of the main body 52 and extending around the main body 52 at the same level as the inner face of the primary insulating barrier. The main body 52 forms a support foot having a first end portion bearing against the bearing wall 3 and a second end portion protruding into the tank to support the piece of equipment at a distance from the tank wall.

More specifically, the main body 52 here has a form of revolution with circular section, with a tapered bottom part 52*a* which is connected at its end of smallest diameter 52*c* to a cylindrical upper part 52*b*. The base of largest diameter of the tapered part 52*a* bears against the bearing wall 3. The tapered part 52*a* extends right through the thickness of the tank wall beyond the level of the primary sealing barrier 7.

The trays 53 and 54 can have different forms. Here, the tray 53 has a square form fitted to the window 51 with a mounting play, whereas the tray 54 has a circular form of smaller diameter.

The tray 53 is extended, inside the tapered bottom part 52*a*, by an inner tray 53*a* which separates the interior space of the tapered bottom part 52*a* into a secondary portion 55 and a primary portion 56. Similarly, the tray 54 is extended, inside the tapered bottom part 52*a*, by an inner tray 54*a* which separates the primary portion 56 from an end portion 57 communicating with the interior space of the tank. The secondary 55 and primary 56 portions of the interior space of the main body 52 are filled with non-structural insulating materials such as glass wool, to limit the conduction of heat. A non-structural insulating packing 58 is also arranged between the tray 54 and the tray 53. Similarly, to complete the secondary insulating barrier around the main body 52, insulating blocks with sandwich structure 60, having a flat section in right-angled triangle form, are positioned under the four corners of the tray 53 between the tray 53 and the bearing wall 3 as well as non-structural insulating packings 59.

Figure 5:
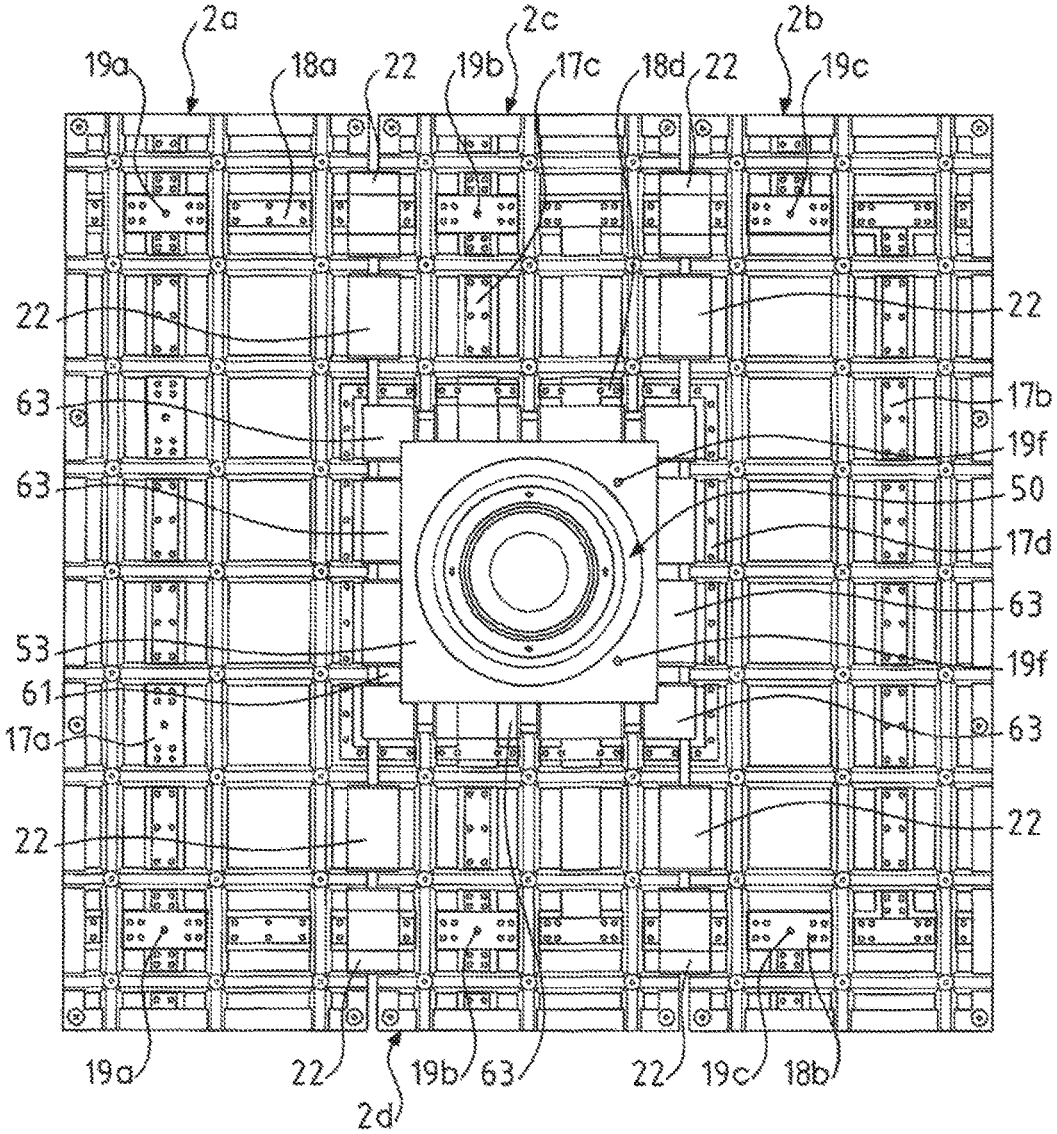
FIG. 5 is a view similar to FIG. 3, also showing bridging elements of the secondary insulating barrier.

Preferably, as in the standard zone of the tank wall, each of these secondary insulating panels 2*a*, 2*b*, 2*c*, 2*d* is associated with the adjacent secondary insulating panels via a plurality of bridging elements 22, represented in FIG. 5. Each bridging element 22 is disposed straddling between the long secondary insulating panel 2*a* or 2*b* and the adjacent short secondary insulating panel 2*c* or 2*d* and is fixed to the inner face of the two secondary insulating panels so as to oppose a mutual separation of said secondary insulating panels.

The tray 53 of the through-element having a square form has a setback 61 along the outer edges of its four sides. The insulating panels 2*a*, 2*b*, 2*c* and 2*d* have setbacks 62 along the four inner edges of the square ring. Bridging elements 63 are disposed straddling over the insulating panels 2*a*, 2*b*, 2*c* and 2*d* and the tray 53, the bridging elements 63 being placed on the bottom of the setbacks 61 of the tray 53 on one side and of the setbacks 62 of the insulating panels 2*a*, 2*b*, 2*c* and 2*d* on the other side. The thickness of the bridging elements 63 is substantially equal to the depth of said setbacks so as to offer a flat support surface for closure plates, belonging to the secondary sealed membrane as will be described below.

The bridging elements 63 are preferably simply placed without being linked to the tray 53 or to the insulating panels 2*a*, 2*b*, 2*c* and 2*d*. This absence of link allows a slight mobility of the bridging elements 63 in response to the differences of thermal deformation between the insulating panels 2*a*, 2*b*, 2*c* and 2*d* and the support foot 50.

As can be seen in FIGS. 3 and 5, a first plurality of anchor plates 17*a*, 18*a*, 17*b* and 18*b* are disposed on the inner face of the ring along the four outer sides of said ring. The distance between each anchor plate 17*a*, 18*a*, 17*b* and 18*b* of the first plurality and the outer side that it runs along is equal to the corrugation interval.

Figure 6:
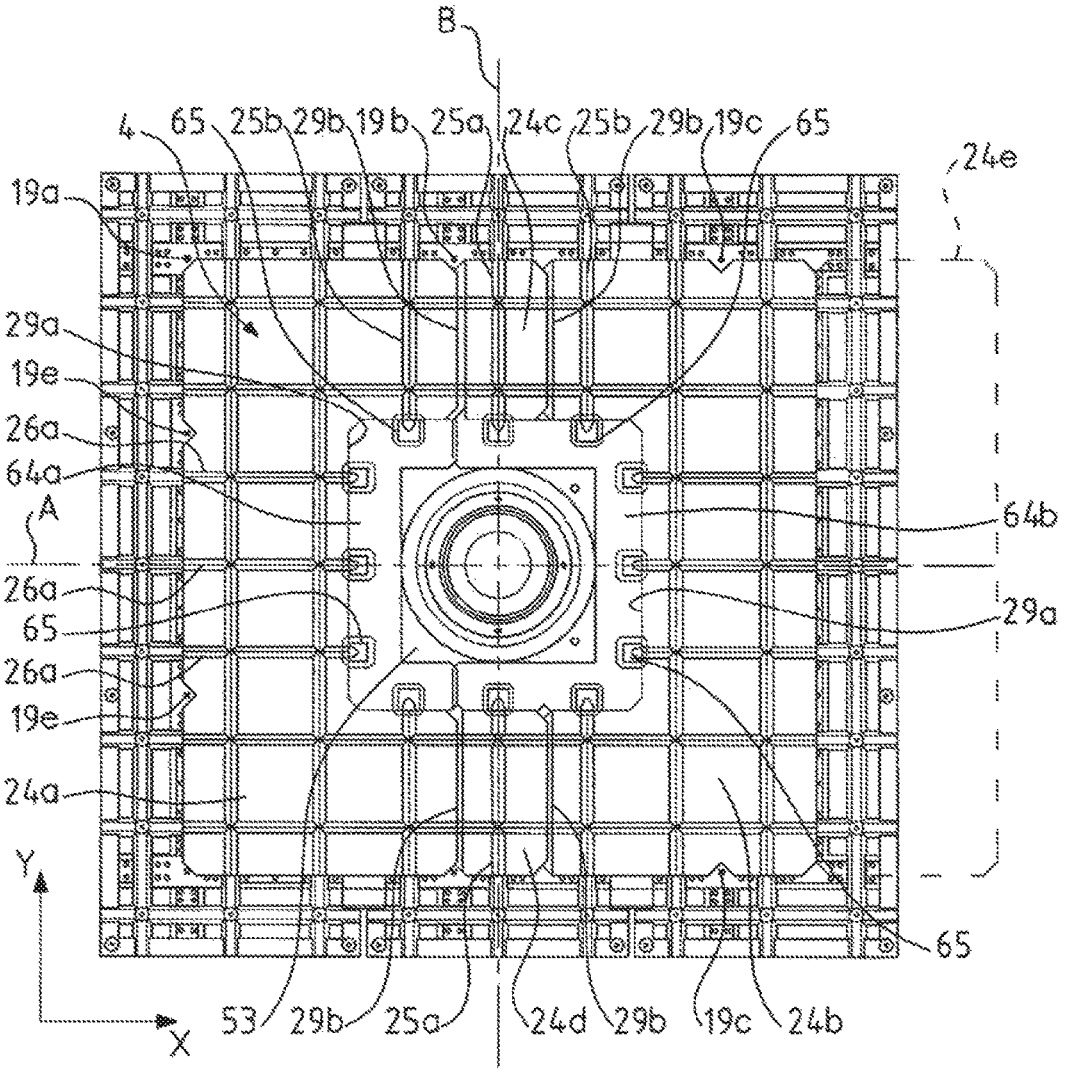
FIG. 6 is a view similar to FIG. 3, also showing a secondary sealed membrane of the tank wall around the support foot.

Referring to FIG. 6, there now follows a description of the secondary sealing membrane 4 around the support foot 50. The corrugated metal sheets of the secondary sealing membrane 4 comprise two notched rectangular metal plates 24*a* and 24*b* 3io wide in the first direction X and 7io long in the second direction Y, which are symmetrical to one another in relation to an axis of symmetry B parallel to the second direction passing through the center of the square window, called second axis of symmetry. Each notched rectangular metal plate 24*a*, 24*b* has three outer edges disposed in line with the first plurality of anchor plates 17*a*, 18*a*, 17*b* and 18*b* and welded onto the first plurality of anchor plates; and an inner edge 29*a*, 29*b* having a notch formed to avoid cutting the square window 51. The notch has a width equal to 1io in the first direction X and a length equal to 3io in the second direction Y such that the notched portion of the inner edge runs along the square window 51.

The corrugated metal sheets of the secondary sealing membrane 4 also comprise two metal retrofit plates 24*c* and 24*d* disposed between the non-notched portions 29*b* of the inner edges of the two notched rectangular metal plates 24*a* and 24*b*. The two metal retrofit plates 24*c* and 24*d* are symmetrical to one another in relation to an axis of symmetry A parallel to the first direction passing through the center of the square window, called first axis of symmetry. Each metal retrofit plate 24*c*, 24*d* is 1io wide in the first direction X and 2io long in the second direction Y and has a corrugation 25*a* aligned on said second axis of symmetry B.

The two longitudinal edges of each metal retrofit plate 24*c*, 24*d* are tightly welded to the inner edges 29*b* of the two notched rectangular metal plates 24*a* and 24*b* and the outer lateral edge of each metal retrofit plate 24*c*, 24*d* is welded to the anchor plates of the first plurality 18*a* and 18*b*.

Finally, the notched portion 29*a* of the inner edge of each notched rectangular metal plate 24*a* and 24*b* and the inner lateral edge of each metal retrofit plate 24*c* and 25*d* are tightly welded to link parts which will be described later.

As can be seen in FIGS. 3 and 5, the inner face of the ring forming the secondary insulating barrier also bears a row of anchor plates 17*c* parallel to the second direction Y which extends on either side of the square window 51 and which is offset to the left side of the second axis of symmetry B by a distance less than 1io, here ½ io.

Returning to FIG. 6, a first of the longitudinal edges of each metal retrofit plate 24*c* and 24*d*, in addition to being welded to the inner edge 29*b* of a first of the two notched rectangular metal plates 24*a*, is welded to the row of anchor plates 17*c* to be retained on the inner face of the ring, whereas the second longitudinal edge of each metal retrofit plate 24*c* and 24*d* is welded to the inner edge 29*b* of the second notched rectangular metal plate 24*b* without being retained on the inner face of the ring.

By virtue of these features, the corrugation borne by each metal retrofit plate 24*c*, 24*d* along the second axis of symmetry B is not blocked on both sides and can therefore work in response to the thermal and mechanical strains. The metal retrofit plates 24*c* and 24*d* thus prolong the second notched rectangular metal plate 24*b* in the first direction. The row of anchor plates 17*c* is symmetrical in relation to the first axis of symmetry A.

As can be seen in FIGS. 3 and 5, a thermal protection coating 91 is disposed on the inner face of said ring at a position symmetrical to the row of anchor plates 17*c* in relation to the second axis of symmetry B, to avoid degrading the inner face by performing the welding between each metal retrofit plate 24*c*, 24*d* and the second notched rectangular metal plate 24*b*.

Returning to FIG. 6, the link parts of the secondary sealed membrane 4 comprise closure plates 64*a*, 64*b* disposed in the window 51 between the tray 53 and the corrugated metal sheets 24*a*, 24*b* 24*c*, 24*d*. Each closure plate 64*a*, 64*b* has a first edge welded onto the tray 53 around the main body 52 and a second edge welded onto a second plurality of anchor plates around the square window. The second plurality of anchor plates 17*d*, 18*d*, visible in FIG. 3 or 5, is disposed on the inner face of said ring along the four inner sides of the ring, so as to run along the edges of the square window 51. The notched portion 29*a* of the inner edge of each notched rectangular metal plate 24*a* and 24*b* and the inner lateral edge of each metal retrofit plate 24*c* and 24*d* are tightly welded onto the closure plates 64*a* and 64*b*.

The closure plates 64*a* and 64*b* here have respective dissymmetrical C and D forms. The closure plates can be cut out in different ways to tightly link the corrugated metal sheets 24*a*, 24*b* 24*c*, 24*d* to the tray 53 all around the main body 52.

A plurality of metal end parts 65 are welded to the closure plates 64*a* and 64*b* and disposed at the intersections between the second edge of each closure plate and each of the three corrugations 25*a*, 25*b* of the first series and of the three corrugations 26*a* of the second series which terminate on the notched portion 29*a* of the inner edge of each notched rectangular metal plate 24*a* and 24*b* and on the inner lateral edge of each metal retrofit plate 24*c*, 24*d* all around the square window 51, so as to close the terminations of said corrugations.

In other words, the corrugations 25*a*, 25*b* and 26*a* meeting the closure plates 64*a*, 64*b* are closed tightly with the end parts 65. The end parts 65 each comprise a baseplate in two parts tightly welded onto the closure plate and a shell tightly welded to the corrugation at the point where it is interrupted.

As can be seen in FIG. 6, the corrugated metal sheets of the sealing membrane further comprise a rectangular metal plate 24*e* 2io wide in the first direction X and 7io long in the second direction Y, which is juxtaposed with the second notched rectangular metal plate 24*b* moving away from the support foot 50 in the first direction X and disposed in the alignment of the second notched rectangular metal plate 24*b* in the first direction X. Alternatively, this plate 24*e* could also be placed on the other side, namely juxtaposed with the first notched rectangular metal plate 24*a*.

By virtue of this arrangement, the corrugated metal sheets 24*a*, 24*b*, 24*c*, 24*d* and 24*e* of the secondary sealing membrane 4 form a pattern of 9io dimensions in the first direction X, which simplifies the connection to the adjacent zones of the tank wall, in particular when the latter are formed by insulating panels 2 and rectangular sheets 24 of 3io dimensions in the first direction X.

The corrugations of the metal sheets 24*a*, 24*b*, 24*c*, 24*d* and 24*e* protrude toward the outside of the tank in the direction of the bearing structure, the inner face of the secondary insulating panels 2*a*, 2*b*, 2*c*, 2*d* having right-angled grooves 14 and 15 receiving the corrugations 25 and 26 of the metal sheets 24*a*, 24*b*, 24*c*, 24*d* and 24*e*.

As can be seen in FIGS. 5 and 6, the secondary insulating panels 2*a*, 2*b*, 2*c*, 2*d* forming the square ring bear two series of three anchoring members 19*a*, 19*b*, 19*c* disposed on the mounting plates 18*a*, 18*b* of the first plurality along the two edges of the square ring parallel to the first direction X. The two series of three anchoring members 19*a*, 19*b*, 19*c* are spaced apart by 7io and symmetrical to one another in relation into the first axis of symmetry X. The three anchoring members 19*a*, 19*b*, 19*c* of each series are disposed at respectively 1io, 4io and 7io along an edge of the square ring parallel to the second direction Y, such that the series of three anchoring members is dissymmetrical in relation to the second axis of symmetry B.

It should be noted in FIG. 6 that the anchoring members 19*c* do not coincide with the corners of the metal sheet 24*b*. This is due to the symmetrical construction of the secondary insulating barrier 1 and of the secondary membrane 4 around the support foot 50, which does not make it possible to place primary insulating panels in such a way that their edges are both in alignment with all the edges of the secondary metal sheets that they cover and are offset from all the edges of the secondary insulating panels to which they are anchored. This is solved by locally departing from the construction principles of the standard zone. The alignment of the corners between the primary insulating panels and the secondary metal sheets can however be re-established on the outer longitudinal edge of the metal sheet 24*e*, as can be seen in FIG. 7.

Figure 7:
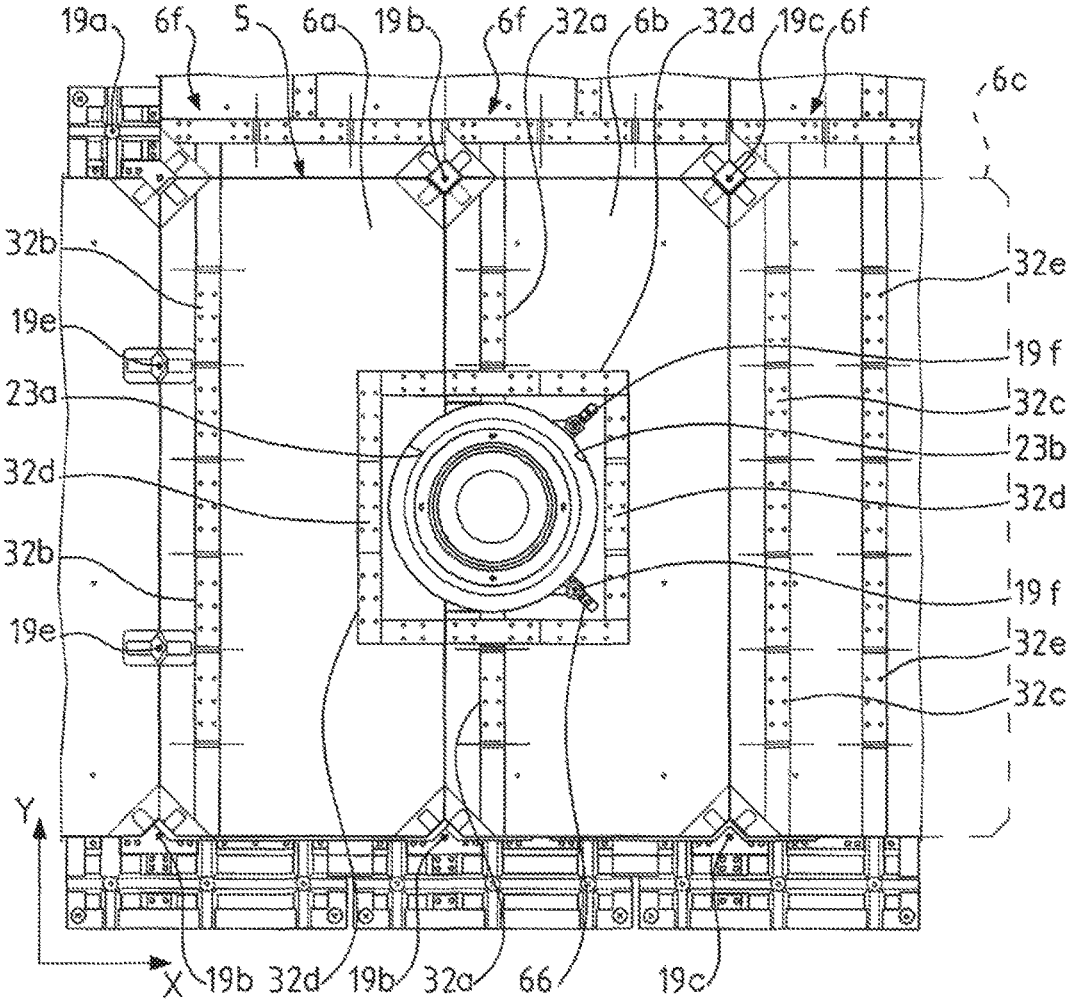
FIG. 7 is a view similar to FIG. 3, also showing the primary insulating barrier of the tank wall around the support foot.

Referring to FIG. 7, there now follows a description of the primary thermally insulating barrier 5 around the support foot 50.

The primary thermally insulating barrier 5 comprises two primary insulating panels 6*a*, 6*b* of rectangular parallelepipedal form having a width of 3io in the first direction X and a length of 7io in the second direction Y. A first of said primary insulating panels 6*a* has its four corners coinciding with the first 19*a* and the second 19*b* anchoring members of each series and is anchored to said first and second anchoring members 19*a*, 19*b* of each series. A second of said primary insulating panels 6*b* has its four corners coinciding with the second 19*b* and the third 19*c* anchoring members of each series and is anchored to said second and third anchoring members 19*b*, 19*c* of each series.

By virtue of this arrangement, the primary thermally insulating barrier 5 can be produced with insulating panels 3io wide, which facilitates the connection with the adjacent zones of the tank wall, Furthermore, a large number of the edges of the primary insulating panels coincide with the anchor plates 17*a*, 18*a*, 17*b*, 18*b* of the first plurality, which makes it possible to use anchoring members 19*a*, 19*b*, 19*c* securely attached to said mounting plates to anchor the primary insulating panels. Nevertheless, the anchoring of the primary panels 6*a*, 6*b* only by the four corners could be insufficient, depending on the mechanical strains that have to be endured.

Each of the two primary insulating panels 6*a*, 6*b* has a respective cutout 23*a*, 23*b* in its edge turned to the side of the through-element, the cutout 23*a* of the first primary insulating panel 6*a*, having a width less than or equal to 1io in the first direction X, and the cutout 23*b* of the secondary primary insulating panel 6*b* having a width less than or equal to 2io in the first direction X. Each of the two cutouts 23*a*, 23*b* has a length less than or equal to 3io in the second direction and is symmetrical in relation to the first axis of symmetry A.

Since the cutouts 23*a*, 23*b* of the primary insulating panels 6*a*, 6*b* do not extend beyond the limits of the underlying square window 51, it is possible to manufacture the primary membrane with corrugations whose interruptions at said cutouts are of a length less than the interruptions of the corrugations of the secondary membrane at the square window.

More specifically, in the embodiment represented, the cutouts 23*a*, 23*b* take the forms of circular arcs that are concentric with the main body 52 and have one and the same radius corresponding to the outer radius of the circular tray 54 taking into account a mounting play.

The mounting plates 17*a* of the first plurality also bear a series of anchoring members 19*e* disposed along the outer longitudinal edge, opposite said cutout 23*a*, of the first primary insulating panel 6*a*, for example two anchoring members 19*e* spaced apart respectively by 2io of the corners of the first primary insulating panel 6*a* and symmetrical to one another in relation to the first axis of symmetry A. The outer longitudinal edge of the first primary insulating panel 6*a* is also anchored to the series of anchoring members 19*e*.

Moreover, in order to also offer five or six anchor points for anchoring to the second primary insulating panel 6*b*, at least one anchoring member 19*f* is fixed onto the tray 53 of the support foot 50 on the side of the second primary insulating panel 6*b*, inside the cutout 23*b* of the inner longitudinal edge of the second primary insulating panel 6*b*. Two anchoring members 19*f* can be seen in FIGS. 5 and 7. The second primary insulating panel 6*b* is thus anchored to the two anchoring members 19*f*.

Figure 8:
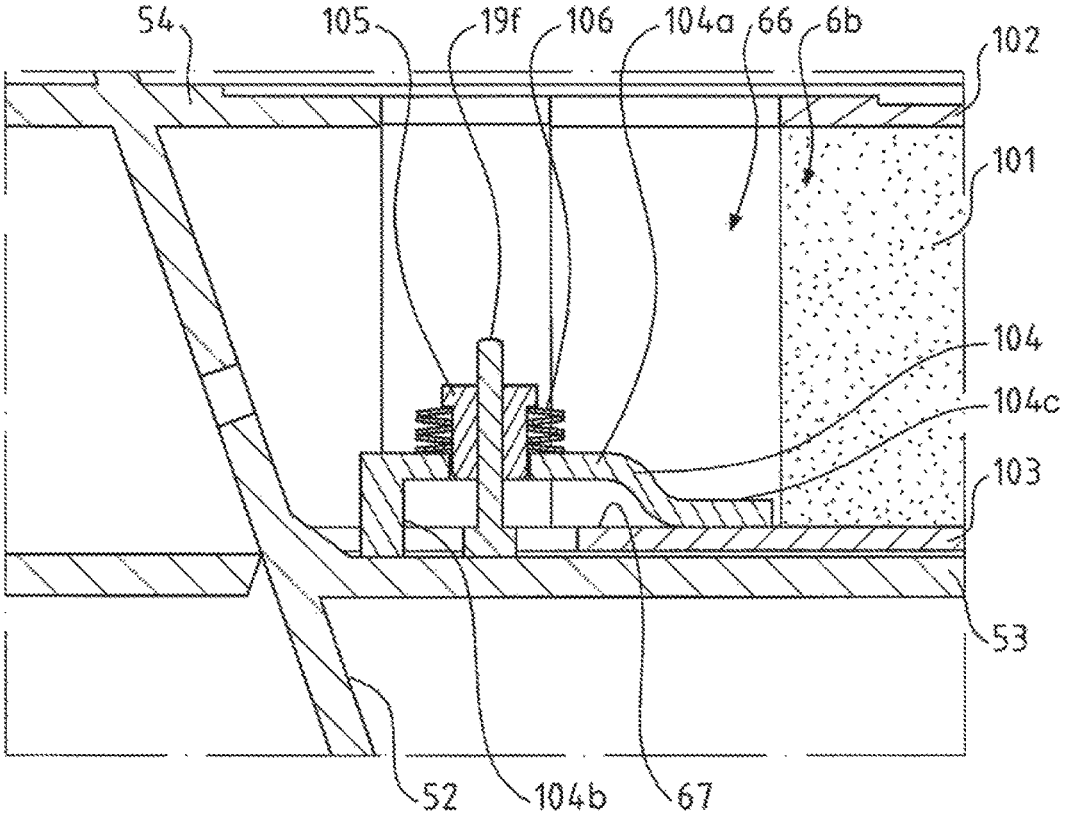
FIG. 8 is an enlarged cross-sectional view of a detail of the support foot and of the primary insulating barrier along the axis VIII-VIII of FIG. 4.

The detailed structure of the tie making it possible to anchor the second primary insulating panel 6*b* to the anchoring member 19*f* is shown in FIG. 8. The primary insulating panels 6*a*, 6*b* have a sandwich structure consisting of a layer of insulating polymer foam 101 sandwiched between two rigid plates 102, 103. The second primary insulating panel 6*b* comprises an oblong well 66 passing through the inner rigid plate 102 and the layer of insulating polymer foam 101 of the second primary insulating panel to reveal an inner surface zone 67 of the outer rigid plate 103. An anchoring part 104 is on the one side fixed to the anchoring member 19*f* of the tray 53 of the through-element and on the other side bearing on the inner surface zone 67 of the inner rigid plate to anchor the second primary insulating panel 6*b*.

More specifically, the anchoring part 104 here comprises:

- a horizontal lug 104*a* passed through by the anchoring member 19*f*,
- a vertical lug 104*b* linked to the end of the horizontal lug 104*a* turned toward the main body 52, the vertical lug 104*b* bearing on the tray 53,
- and a bearing portion 104*c* linked to the other end of the horizontal lug 104*a* and prolonging the latter by being deflected toward the outer rigid plate 103.

A nut 105 bears on the horizontal lug 104*a* via Belleville spring washers 106.

Figure 9:
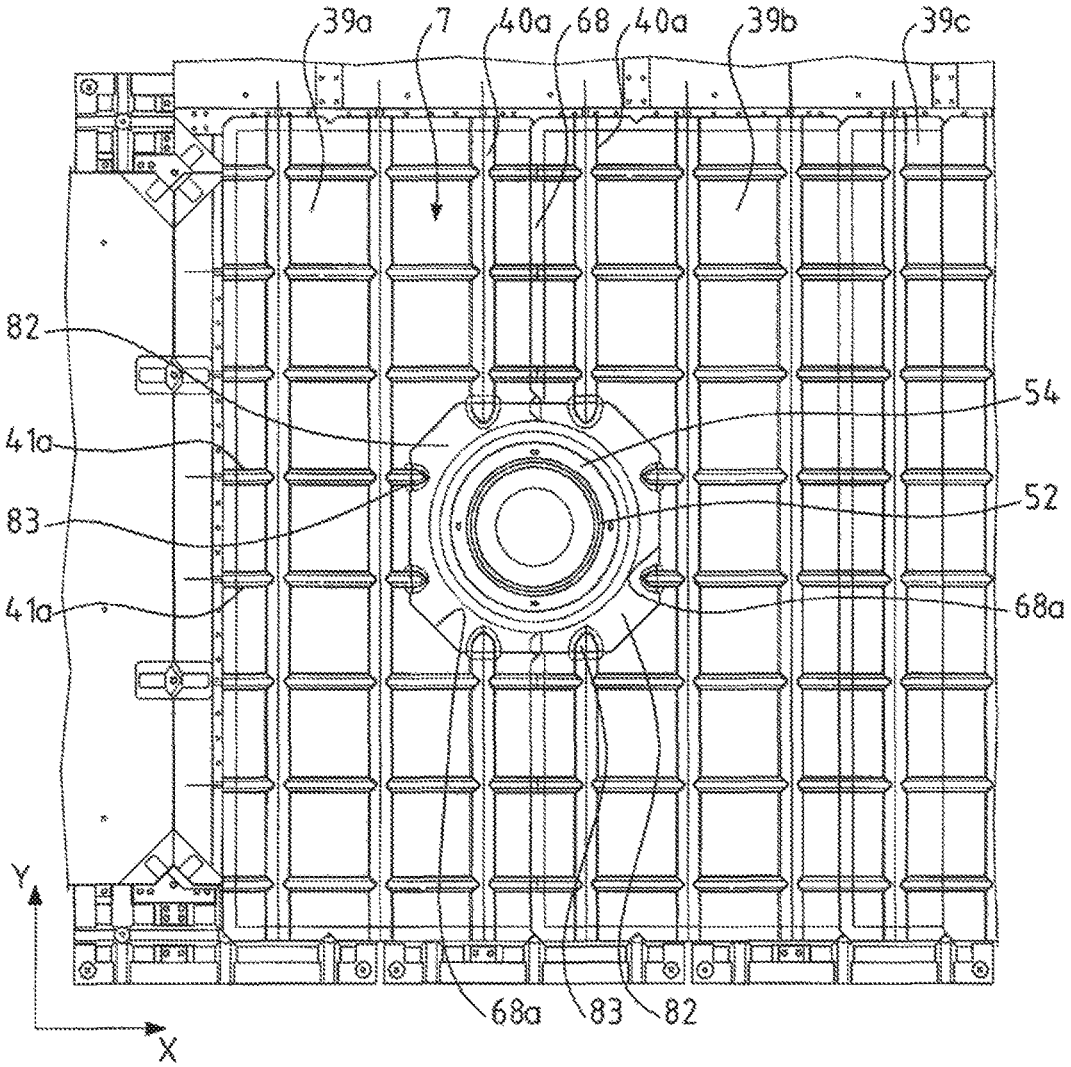
FIG. 9 is a view similar to FIG. 3, also showing the primary sealed membrane of the tank wall around the support foot.

Referring to FIG. 9, there now follows a description of the primary membrane 7 around the support foot 50.

The corrugated metal sheets of the primary sealed membrane 7 around the support foot 50 comprise two primary notched rectangular plates 39*a* and 39*b* having a width of 3io in the first direction X and a length of 9io in the second direction Y and overall symmetrical to one another in relation to the second axis of symmetry B. Each of the two primary notched rectangular plates 39*a* and 39*b* is overall symmetrical in relation to the first axis of symmetry A. In fact, the edges of the plates 39*a* and 39*b* intended to be welded with overlap are slightly dissymmetrical precisely because of the overlaps effected.

Each of the two primary notched rectangular plates 39*a* and 39*b* has an inner longitudinal edge 68 having a notch to circumvent the through-element, said notch having a width less than 1.5io in the first direction X and a length less than 3io in the second direction Y such that the notched portion 68*a* of the inner longitudinal edge 68 interrupts two corrugations 41*a* of the first series and one corrugation 40*a* of the second series of each of the two primary notched rectangular plates 39*a* and 39*b*.

The notched portion 68*a* of the inner longitudinal edge of each primary notched rectangular plate 39*a* and 39*b* is tightly welded to link parts tightly linked to the through-element around the support foot 50 at the inner face of the primary insulating panels 6*a*, 6*b*.

For the most part, the sealed link between the primary notched rectangular plates 39*a* and 39*b* and the circular tray 54 can be produced in a way similar to the teaching of WO-A-2011/157915, with two primary closure plates 82 and eight end parts 83.

As can be seen in FIG. 7, a third primary insulating panel 6*c* of rectangular parallelepipedal form having a width of 3io in the first direction X and a length of 7io in the second direction Y is juxtaposed with the second primary insulating panel 6*b* opposite the first primary insulating panel 6*a*.

The inner face of the first, second and third primary insulating panels 6*a*, 6*b*, 6*c* bears metal anchor plates to anchor the primary notched rectangular plates 6*a* and 6*b*, the metal anchor plates comprising:

- first metal anchor plates 32*a* disposed on the second primary insulating panel along the second axis of symmetry B to anchor the non-notched portions of the inner longitudinal edge 68 of the two primary notched rectangular plates 6*a*, 6*b*,
- second metal anchor plates 32*b* disposed on the first primary insulating panel 6*a* along a line parallel to the second axis of symmetry B at a distance of 3io from the first metal anchor plates 32*a* to anchor the outer longitudinal edge of a first of the two primary notched rectangular plates 39*a*,
- third metal anchor plates 32*c* disposed on the third primary insulating panel 6*c* along a line parallel to the second axis of symmetry B at a distance of 3io from the first metal anchor plates 32*a* to anchor the outer longitudinal edge of the second primary notched rectangular plate 39*b*,
- and fourth metal anchor plates 32*d* disposed on the first and second primary insulating panels 6*a*, 6*b* in the form of a square frame concentric with the square window 51 accommodating the support foot 50, to anchor the notched portions 68*a* of the inner longitudinal edge of the two primary notched rectangular plates 39*a*, 39*b*.

The top of FIG. 7 also shows, partially, three primary insulating panels 6*f* of a zone adjacent to the singular zone.

As can be seen in FIG. 9, the corrugated metal sheets of the primary sealed membrane also comprise a narrow rectangular plate 39*c* having a width of 1io in the first direction X and a length of 9io in the second direction Y juxtaposed with the second primary notched rectangular plate 39*b* opposite the first primary notched rectangular plate 39*a*.

Fifth metal anchor plates 32*e* are disposed on the third primary insulating panel 6*c* along a line parallel to the second axis of symmetry B at a distance of 1io from the third metal anchor plates 32*c* to anchor the outer longitudinal edge of the narrow rectangular plate 39*c*.

By virtue of this arrangement, the corrugated metal sheets 39*a*, 39*b*, 39*c* and 24*e* of the secondary sealing membrane 4 form, around the support foot 50, a network of corrugations 40, 41 that is regular and symmetrical in relation to the two axes of symmetry A and B. Furthermore, the narrow rectangular plate 39*c* makes it possible to realign, in the first direction X, the outer longitudinal edge with the edges of the primary corrugated metal sheets of an adjacent standard zone, which simplifies the connection of the singular zone to the adjacent zones of the tank wall, which are formed by insulating panels 6 and rectangular sheets 39 of dimensions 3io in the first direction X.

As can be seen in FIGS. 6 and 9, the corrugations of the primary sealing membrane 7 are offset by a half-corrugation interval in each of the two directions X and Y in relation to the corrugations of the secondary sealing membrane 4. The corrugated metal sheets 39*a*, 39*b* of the primary sealing membrane are interrupted at an opening formed by the notched portions 68*a*, said opening interrupting two corrugations 40*a*, 41*a* of each series of corrugations of the primary sealing membrane 7, said opening being centered at a position situated in the middle of the two interrupted corrugations 40*a*, 41*a* of each series of corrugations of the primary sealing membrane. By comparison, the corrugated metal sheets 24*a*, 24*b*, 24*c*, 24*d* of the secondary sealing membrane 4 are interrupted at an opening, formed in particular by the notched portions 29*a* and the inner edges of the retrofit plates 24*c* and 24*d*. Said opening interrupts a sequence of three corrugations 25*a*, 25*b*, 26*a* of each series of corrugations of the secondary sealing membrane 4. The opening of the secondary sealing membrane is thus concentric with the opening of the primary sealing membrane, and with the support foot 50. The opening of the secondary sealing membrane 4 is centered at a position situated at the intersection of the second corrugation of the sequence of three corrugations 26*a* belonging to the first series of the secondary sealing membrane and of the second corrugation

25*a* of the sequence of three corrugations 25*a*, 25*b* belonging to the second series of the secondary sealing membrane 4.

In another embodiment, the corrugations of the secondary metal sheets 24, 24*a*, 24*b*, 24*c* protrude toward the interior of the tank, contrary to the corrugations of the preceding embodiment, and the primary insulating panels 6, 6*a*, 6*b*, 6*c* each have an outer plate 31 having right-angled grooves receiving the corrugations of the corrugated metal sheets of the secondary sealing membrane 4. In this other embodiment, not represented, the corrugated metal sheets 24, 24*a*, 24*b*, 24*c* of the secondary sealing membrane 4 also comprise two series of right-angled corrugations 25, 26. As in the preceding embodiments, the corrugated metal sheets 24, 24*a*, 24*b*, 24*c* are fixed onto the inner plate 10 of the insulating panels 2 of the secondary thermally insulating barrier 1 via metal mounting plates.

However, in this embodiment, the outer plate 31 of the insulating panels 6 of the primary thermally insulating barrier 5 have two series of grooves at right angles to one another so as to form a network of grooves. The grooves are thus intended to receive the corrugations 25, 26, protruding toward the interior of the tank, formed on the corrugated metal sheets 24 of the secondary sealing membrane 4.

In such an embodiment, the secondary sealing membrane comprises a general structure identical to that represented in FIG. 6, the only difference lying in the orientation of the corrugations toward the interior of the tank.

Moreover, it should be noted that while the invention has been described above in relation to a through-element which is a support foot, it is in no way limited to such an embodiment. A similar arrangement can be employed for other through-elements.

Preferably, the through-element is centered on a position corresponding to the intersection between the directing lines of two corrugations at right angles to one another of the secondary metal sheets and has a symmetry of revolution or a symmetry of order N, where N is an even integer number, around an axis at right angles to the bearing wall.

In embodiments not represented, the main body of the through-element is a sealed duct passing through the wall to define a passage between the interior space of the tank and the outside of the tank, or a sump structure passing through the tank wall at the bottom of the tank and intended to accommodate a suction member, for example a pump.

The sump structure can comprise:

- a primary cup connected to the primary sealing membrane,
- a secondary cup, concentric to the primary cup, and connected to the secondary sealing membrane,
- primary insulating materials housed between the primary and secondary cups;
- secondary insulating materials interposed between the secondary cup and the bearing structure.

In a simplified embodiment, the multilayer structure of the tank wall is limited to the secondary sealed membrane and the secondary insulating barrier, whereas all the primary elements are eliminated.

The tank described above can be used in different types of installation, in particular in an onshore installation or in a floating structure such as a methane tanker or the like.

Figure 10:
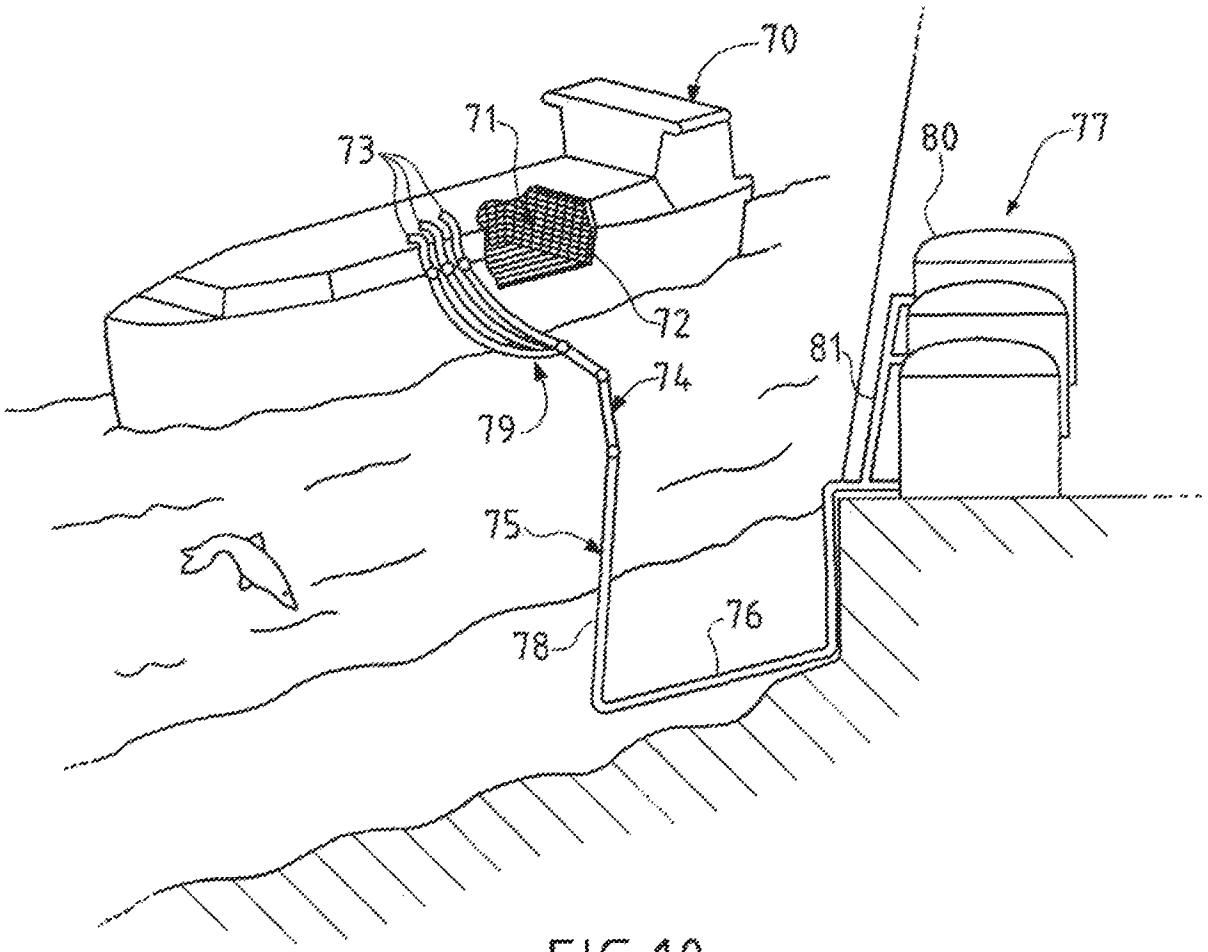
FIG. 10 is a cutaway schematic representation of a methane tanker tank comprising a sealed and thermally insulating tank for storing a fluid and a terminal for loading/unloading this tank.

Referring to FIG. 10, a cutaway view of a methane tanker 70 shows such a sealed and insulated tank 71 of generally prismatic form mounted in the double hull 72 of the ship.

As is known per se, loading/unloading pipelines 73 disposed on the upper deck of the ship can be coupled, by means of appropriate connectors, to a maritime or port terminal to transfer a cargo of LNG from or to the tank 71.

FIG. 10 also represents an example of a maritime terminal comprising a loading and unloading station 75, a submarine duct 76 and an onshore installation 77. The loading and unloading station 75 is a fixed offshore installation comprising a mobile arm 74, a riser 78 which supports the mobile arm 74. The mobile arm 74 bears a bundle of insulated flexible pipes 79 that can be connected to the loading/unloading pipelines 73. The orientable mobile arm 74 is adapted to all methane tanker templates. A link duct that is not represented extends inside the riser 78. The loading and unloading station 75 allows the loading and unloading of the methane tanker 70 from or to the onshore installation 77. The latter comprises liquefied gas storage tanks 80 and link ducts 81 linked by the submarine duct 76 to the loading or unloading station 75. The submarine duct 76 allows the transfer of the liquefied gas between the loading or unloading station 75 and the onshore installation 77 over a great distance, for example 5 km, which makes it possible to keep the methane tanker 70 at a great distance from the coast during the loading and unloading operations.

To create the pressure necessary to the transfer of the liquefied gas, pumps embedded in the ship 70 and/or pumps with which the onshore installation 77 is equipped and/or pumps with which the loading and unloading station 75 is equipped are implemented.

Although the invention has been described in relation to several particular embodiments, it is clear that it is no way limited thereto and that it comprises all the technical equivalents of the means described and their combinations provided the latter fall within the scope of the invention.

The use of the verb "comprise" or "include" and its conjugated forms does not preclude the presence of elements or steps other than those stated in a claim. The use of the indefinite article "a" or "an" for an element or a step does not preclude, unless otherwise stipulated, the presence of a plurality of such elements or steps.

In the claims, any reference symbol between parentheses should not be interpreted as a limitation of the claim.

The invention claimed is:

1. A sealed and thermally insulating tank intended for the storage of a fluid, said tank comprising a tank wall fixed to a flat bearing wall, the tank wall comprising a sealing membrane and a thermally insulating barrier disposed between the bearing wall and the sealing membrane, the sealing membrane essentially consisting of a plurality of corrugated metal sheets tightly welded to one another which form a first series of equidistant parallel rectilinear corrugations extending in a first direction of the plane of the bearing wall and a second series of equidistant parallel rectilinear corrugations extending in a second direction of the plane of the bearing wall, the second direction being at right angles to the first direction, the distance between two adjacent corrugations of the first series and the distance between two adjacent corrugations of the second series being equal to a predetermined corrugation interval io, the corrugated metal sheets having rectangular forms whose sides are parallel to, respectively, the first direction and the second direction of the plane of the bearing wall and whose dimensions are substantially equal to integer multiples of the corrugation interval, each edge of a corrugated metal sheet being situated between two adjacent corrugations parallel to said edge, the thermally insulating barrier essentially consisting of a plurality of juxtaposed insulating panels each having an inner face which forms a support surface for the sealing membrane, the insulating panels having rectangular parallelepipedal forms whose sides are parallel to, respectively, the first direction and the second direction of the plane of the bearing wall and whose dimensions in projection in the plane of the bearing wall are substantially equal to integer multiples of the corrugation interval, metal anchor plates being fixed onto the inner faces of the insulating panels and the corrugated metal sheets having edges welded to said anchor plates to retain the sealing membrane against said support surface, the sealed tank being equipped with a through-element passing through the tank wall, wherein the thermally insulating barrier around the through-element comprises a plurality of insulating panels which form a ring of square form around the through-element, said ring having outer sides measuring substantially 9io which are parallel to, respectively, the first direction and the second direction of the plane of the bearing wall, said ring delimiting, at its center, a square window whose sides measure substantially 3io and which are also parallel to, respectively, the first direction and the second direction of the plane of the bearing wall, such that the through-element passes through the thermally insulating barrier in said square window, a first plurality of anchor plates being disposed on the inner face of said ring along the four outer sides of said ring, the distance between each anchor plate of the first plurality and the outer side that it runs along being equal to the corrugation interval, link parts linked tightly to the through-element being disposed in the square window around the through-element on the inner face of the insulating panels which form the ring, and wherein the corrugated metal sheets of the sealing membrane around the through-element comprise:

two notched rectangular metal plates 3io wide in the first direction and 7io long in the second direction, which are symmetrical to one another in relation to an axis of symmetry parallel to the second direction passing through the center of the square window, called second axis of symmetry, each notched rectangular metal plate having three outer edges disposed in line with the first plurality of anchor plates and welded onto the first plurality of anchor plates and an inner edge having a notch formed to avoid cutting said square window, said notch having a width equal to 1io in the first direction and a length equal to 3io in the second direction so that the notched portion of the inner edge runs along the square window, and two metal retrofit plates disposed between the non-notched portions of the inner edges of the two notched rectangular metal plates, the two metal retrofit plates being symmetrical to one another in relation to an axis of symmetry parallel to the first direction passing through the center of the square window, called first axis of symmetry, each metal retrofit plate being 1io wide in the first direction and 2io long in the second direction and having a corrugation aligned on said second axis of symmetry, the two longitudinal edges of each metal retrofit plate being tightly welded to the inner edges of the two notched rectangular metal plates, and the outer lateral edge of each metal retrofit plate being welded to the anchor plates of the first plurality, the notched portion of the inner edge of each notched rectangular metal plate and the inner lateral edge of each metal retrofit plate being tightly welded to said link parts.

2. The tank as claimed in claim 1, wherein the inner face of said ring also bears a row of anchor plates parallel to the second direction which extends on either side of the square window and which is offset to one side of the second axis of symmetry by a distance less than 1io, and wherein a first of the longitudinal edges of each metal retrofit plate, in addition to being welded to the inner edge of a first of the notched rectangular metal plates, is welded to the row of anchor plates to be retained on the inner face of said ring, whereas the second longitudinal edge of each metal retrofit plate is welded to the inner edge of the second notched rectangular metal plate without being retained on the inner face of said ring.

3. The tank as claimed in claim 2, wherein a thermal protection coating is disposed on the inner face of said ring in a position symmetrical to the row of anchor plates in relation to the second axis of symmetry, to avoid degrading the inner face by performing the welding between each metal retrofit plate and the second notched rectangular metal plate.

4. The tank as claimed in claim 1, wherein the through-element comprises a main body disposed substantially at the center of the square window and extending in the direction of thickness of the tank wall and a tray parallel to the bearing wall linked to the periphery of the main body and extending around the main body at the same level as the inner face of the ring, the link parts comprising closure plates disposed in the window between the tray and the corrugated metal sheets, each closure plate having a first edge welded onto the tray around the main body and a second edge welded onto a second plurality of anchor plates around the square window, the second plurality of anchor plates being disposed on the inner face of said ring along the four inner sides of said ring, so as to run along the edges of the square window, and wherein the notched portion of the inner edge of each notched rectangular metal plate and the inner lateral edge of each metal retrofit plate are tightly welded onto the closure plates.

5. The tank as claimed in claim 4, wherein the tray of the through-element has a square form, the tray has a setback along the outer edges of its four sides, the insulating panels having setbacks along the four inner edges of the square ring, bridging elements being disposed straddling the insulating panels and the tray, the bridging elements being placed on the bottom of the setbacks of the tray on one side and of the insulating panels on the other side, the thickness of the bridging elements being substantially equal to the depth of said setbacks so as to offer a flat support surface for the closure plates.

6. The tank as claimed in claim 4, further comprising a plurality of metal end parts welded to the closure plates and disposed at the intersections between the second edge of each closure plate and each of the corrugations of the first and second series which terminate on the notched portion of the inner edge of each notched rectangular metal plate and on the inner lateral edge of each metal retrofit plate all around the square window, so as to close the terminations of said corrugations.

7. The tank as claimed in claim 4, wherein the main body of the through-element is a support foot for a piece of equipment intended to be placed in the tank, the support foot having a first end portion bearing against the bearing wall and a second end portion protruding into the tank to support the piece of equipment at a distance from the tank wall.

8. The tank as claimed in claim 1, wherein the corrugated metal sheets of the sealing membrane further comprise a rectangular metal plate 2io wide in the first direction and 7io long in the second direction, which is juxtaposed with the first or second notched rectangular metal plate moving away from the through-element in the first direction and disposed in the alignment of the first or second notched rectangular metal plate in the first direction.

9. The tank as claimed in claim 1, wherein the ring of square form of the thermally insulating barrier consists of two long insulating panels having a width of 3io in the first direction and a length of 9io in the second direction and two short insulating panels having a width of 3io in the first direction and a length of 3io in the second direction, the long insulating panels being disposed in the alignment of one another in the first direction spaced apart by a distance of 3io in the first direction to delimit the square window in the first direction, the short insulating panels being disposed between the two long insulating panels in the alignment of one another in the second direction and spaced apart by a distance of 3io in the second direction to delimit the square window in the second direction.

10. The tank as claimed in claim 1, wherein the corrugations of the metal sheets protrude toward the outside of the tank toward the bearing wall, the inner face of the secondary insulating panels having right-angled grooves receiving the corrugations of the metal sheets.

11. The tank as claimed in claim 1, wherein said thermally insulating barrier is a secondary thermally insulating barrier retained against the bearing wall, and said sealing membrane is a secondary sealing membrane borne by the secondary thermally insulating barrier, the tank wall further comprising a primary thermally insulating barrier resting against the secondary sealing membrane and a primary sealing membrane borne by the primary thermally insulating barrier and intended to be in contact with the fluid contained in the tank, and wherein the insulating panels forming the square ring bear two series of three anchoring members disposed on the mounting plates of the first plurality along the two edges of the square ring parallel to the first direction, the two series of three anchoring members being spaced apart by 7io and symmetrical to one another in relation to the first axis of symmetry, the three anchoring members of each series being disposed at, respectively, 1io, 4io and 7io along an edge of the square ring parallel to the second direction such that the series of three anchoring members is dissymmetrical in relation to the second axis of symmetry, the primary thermally insulating barrier around the through-element comprising two primary insulating panels of rectangular parallelepipedal form having a width of 3io in the first direction and a length of 7io in the second direction, a first of said primary insulating panels having its four corners coinciding with the first and the second anchoring members of each series and being anchored to said first and second anchoring members of each series, a second of said primary insulating panels having its four corners coinciding with the second and the third anchoring members of each series and being anchored to said second and third anchoring members of each series, each of the two primary insulating panels having a respective cutout in its edge turned to the side of the through-element, the cutout of the first primary insulating panel having a width less than or equal to 1io in the first direction, the cutout of the second primary insulating panel having a width less than or equal to 2io in the first direction, each of the two cutouts having a length less than or equal to 3io in the second direction being symmetrical in relation to the first axis of symmetry.

12. The tank as claimed in claim 11, wherein the mounting plates of the first plurality also bear a series of anchoring members disposed along the outer longitudinal edge, opposite said cutout, of the first primary insulating panel the outer longitudinal edge of the first primary insulating panel being anchored to the series of anchoring members, and wherein at least one anchoring member is fixed onto the tray of the through-element on the side of the second primary insulating panel, inside the cutout of the inner longitudinal edge of the second primary insulating panel, the second primary insulating panel being anchored to said at least one anchoring member.

13. The tank as claimed in claim 12, wherein the primary insulating panels have a sandwich structure consisting of a layer of insulating polymer foam sandwiched between two rigid plates, the second primary insulating panel comprising an oblong well passing through the inner rigid plate and the layer of insulating polymer foam of the second primary insulating panel to reveal an internal surface zone of the outer rigid plate, an anchoring part being on the one side fixed to the anchoring member of the tray of the through-element and on the other side bearing on the inner surface zone of the inner rigid plate to anchor the second primary insulating panel.

14. The tank as claimed in claim 11, wherein the corrugated metal sheets of the primary sealed membrane around the through-element comprise two primary notched rectangular plates having a width of 3io in the first direction and a length of 9io in the second direction and symmetrical to one another in relation to the second axis of symmetry, each of the two primary notched rectangular plates being symmetrical in relation to the first axis of symmetry, each of the two primary notched rectangular plates having an inner longitudinal edge having a notch to circumvent the through-element, said notch having a width less than 1.5io in the first direction and a length less than 3io in the second direction so that the notched portion of the inner longitudinal edge interrupts two corrugations of the first series and one corrugation of the second series of each of the two primary notched rectangular plates, the notched portion of the inner longitudinal edge of each primary notched rectangular plate being tightly welded to link parts tightly linked to the through-element around the through-element on the inner face of the primary insulating panels.

15. The tank as claimed in claim 14, wherein a third primary insulating panel of rectangular parallelepipedal form having a width of 3io in the first direction and a length of 7io in the second direction is juxtaposed with the second primary insulating panel opposite the first primary insulating panel, and wherein the inner face of the first, second and third primary insulating panels bears metal anchor plates to anchor the primary notched rectangular plates, the metal anchor plates comprising:

first metal anchor plates disposed on the second primary insulating panel along the second axis of symmetry B to anchor the non-notched portions of the inner longitudinal edge (68) of the two primary notched rectangular plates, second metal anchor plates disposed on the first primary insulating panel along a line parallel to the second axis of symmetry B at a distance of 3io from the first metal anchor plates to anchor the outer longitudinal edge of a first of the two primary notched rectangular plates, third metal anchor plates disposed on the third primary insulating panel along a line parallel to the second axis of symmetry at a distance of 3io from the first metal anchor plates to anchor the outer longitudinal edge of the second primary notched rectangular plate, and fourth metal anchor plates disposed on the first and second primary insulating panels in the form of a square frame concentric with the square window accommodating the through-element to anchor the notched portions of the inner longitudinal edge of the two primary notched rectangular plates.

16. The tank as claimed in claim 15, wherein the corrugated metal sheets of the primary sealed membrane further comprise a narrow rectangular plate having a width of 1io in the first direction and a length of 9io in the second direction juxtaposed with the second primary notched rectangular plate opposite the first primary notched rectangular plate fifth metal anchor plates being disposed on the third primary insulating panel along a line parallel to the second axis of symmetry at a distance of 1io from the third metal anchor plates to anchor the outer longitudinal edge of the narrow rectangular plate.

17. A ship for transporting a fluid, the ship comprising a double hull and a a sealed and thermally insulating tank as claimed in claim 1 disposed in the double hull.

18. A method for loading or unloading a ship as claimed in claim 17, wherein a fluid is routed through insulated pipelines from or to a floating or onshore storage installation to or from the a sealed and thermally insulating tank of the ship.

19. A transfer system for a fluid, the system comprising a ship as claimed in claim 17, insulated pipelines arranged so as to link the tank installed in the hull of the ship to a floating or onshore storage installation and a pump for driving a fluid through the insulated pipelines from or to the floating or onshore storage installation to or from the a sealed and thermally insulating tank of the ship.

* * * * *